US010134402B2

(12) United States Patent
Zhou et al.

(10) Patent No.: US 10,134,402 B2
(45) Date of Patent: Nov. 20, 2018

(54) SIGNAL PROCESSING METHOD AND APPARATUS

(71) Applicant: HUAWEI TECHNOLOGIES CO., LTD., Shenzhen, Guangdong (CN)

(72) Inventors: Xuan Zhou, Beijing (CN); Lei Miao, Beijing (CN); Zexin Liu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/264,922

(22) Filed: Sep. 14, 2016

(65) Prior Publication Data

US 2017/0011746 A1 Jan. 12, 2017

Related U.S. Application Data

(63) Continuation of application No. PCT/CN2014/092658, filed on Dec. 1, 2014.

(30) Foreign Application Priority Data

Mar. 19, 2014 (CN) ..... 2014 1 0101859

(51) Int. Cl.
*G10L 19/00* (2013.01)
*G10L 19/002* (2013.01)
(Continued)

(52) U.S. Cl.
CPC ..... *G10L 19/002* (2013.01); *G10L 19/0204* (2013.01); *G10L 19/032* (2013.01)

(58) Field of Classification Search
CPC ..... G10L 19/00; G10L 19/002; G10L 19/032
(Continued)

(56) References Cited

U.S. PATENT DOCUMENTS 5,394,508 A * 2/1995 Lim ..... G10L 19/0212 704/200.1
5,469,474 A 11/1995 Kitabatake
(Continued)

FOREIGN PATENT DOCUMENTS

CN 1119375 A 3/1996
CN 1127913 A 7/1996
(Continued)

OTHER PUBLICATIONS

"G.729—based embedded variable bit-rate coder: An 8-32 kbit/s scalable wideband coder bitstream interoperable with G.729;G.729.1(05/06)",ITU-T Standard, International Telecommunication Union Geneva;CH, No. 729.1 (05/06), May 29, 2006, pp. 1-100, XP017466254.

*Primary Examiner* — Paras D Shah
(74) *Attorney, Agent, or Firm* — Jinghua Karen Tang

(57) ABSTRACT

The present disclosure provide a signal processing method and apparatus. The method includes: determining a total quantity of to-be-allocated bits corresponding to a current frame; implementing primary bit allocation on to-be-processed sub-bands; performing a primary information unit quantity determining operation for each sub-band that has undergone the primary bit allocation; selecting sub-bands for secondary bit allocation from the to-be-processed sub-bands according to at least one of a sub-band characteristic of each sub-band of the to-be-processed sub-bands or the total quantity of surplus bits; implementing secondary bit allocation on the sub-bands for secondary bit allocation; and performing a secondary information unit quantity determining operation for each sub-band of the sub-bands for secondary bit allocation.

26 Claims, 12 Drawing Sheets

(51) Int. Cl.
*G10L 19/02* (2013.01)
*G10L 19/032* (2013.01)

(58) Field of Classification Search
USPC ..... 704/500–504
See application file for complete search history.

(56) References Cited

U.S. PATENT DOCUMENTS 5,533,052 A * 7/1996 Bhaskar ..... G10L 19/0212 341/76
5,684,922 A * 11/1997 Miyakawa ..... H04B 1/665 375/241
6,151,442 A * 11/2000 Ueno ..... G10L 19/032 386/327
6,199,038 B1 3/2001 Tsutsui
6,226,616 B1 5/2001 You et al.
6,308,150 B1 10/2001 Neo et al.
6,339,757 B1 * 1/2002 Teh ..... H04B 1/665 704/219
8,108,219 B2 1/2012 Liebchen
2001/0050959 A1 * 12/2001 Nishio ..... G10L 19/0208 375/243
2004/0247037 A1 * 12/2004 Honma ..... G10L 21/038 375/259
2005/0163323 A1 * 7/2005 Oshikiri ..... G10L 19/24 381/22
2005/0231396 A1 * 10/2005 Dunn ..... G10L 19/032 341/50
2006/0206316 A1 * 9/2006 Sung ..... G10L 19/093 704/207
2008/0010064 A1 * 1/2008 Takeuchi ..... G10L 19/035 704/229
2010/0241433 A1 9/2010 Herre et al.
2012/0101813 A1 * 4/2012 Vaillancourt ..... G10L 19/20 704/206
2012/0296640 A1 * 11/2012 Yamanashi ..... G10L 19/0208 704/204
2013/0080157 A1 3/2013 Kim et al.
2013/0110507 A1 5/2013 Gao
2013/0290003 A1 * 10/2013 Choo ..... G10L 19/008 704/500
2014/0200901 A1 * 7/2014 Kawashima ..... G10L 21/0388 704/500
2014/0214411 A1 * 7/2014 Daimou ..... G10L 19/0212 704/206
2014/0219459 A1 * 8/2014 Daniel ..... G10L 19/002 381/23
2015/0162011 A1 * 6/2015 Qi ..... G10L 19/002 704/500
2015/0206541 A1 * 7/2015 Qi ..... G10L 19/035 704/229
2016/0049157 A1 * 2/2016 Mittal ..... G10L 19/038 704/500
2017/0223356 A1 * 8/2017 Sung ..... H04N 19/124

FOREIGN PATENT DOCUMENTS

CN 1419349 A 5/2003
CN 1463496 A 12/2003
CN 103544957 A 1/2014
EP 1431963 A1 6/2004
EP 1575032 A2 9/2005
JP H02123828 A 5/1990
JP H09214348 A 8/1997
JP 2003280698 A 10/2003
KR 100224812 B1 10/1999
RU 2418322 C2 5/2011
WO 9715983 A1 5/1997
WO 2013147666 A1 10/2013

* cited by examiner

SIGNAL PROCESSING METHOD AND APPARATUS

CROSS-REFERENCE TO RELATED APPLICATIONS

This application is a continuation of International Application No. PCT/CN2014/092658, filed on Dec. 1, 2014, which claims priority to Chinese Patent Application No. 201410101859.1, filed on Mar. 19, 2014, both of which are hereby incorporated by reference in their entireties.

TECHNICAL FIELD

The present disclosure relates to audio encoding and decoding technologies, and more specifically, to a signal processing method and apparatus.

BACKGROUND

In an existing frequency-domain encoding algorithm, during bit allocation, the following processing is included: allocating bits to each sub-band according to a sub-band envelope; sorting sub-bands in ascending order according to a quantity of allocated bits; starting encoding from a sub-band with a smallest quantity of allocated bits; and evenly allocating surplus bits left in an encoded sub-band to remaining unencoded sub-bands, where bits left in each sub-band are insufficient for encoding one information unit. Because allocation of surplus bits is merely even allocation to sub-bands with larger quantities of originally allocated bits determined by energy envelopes, a waste of bits is caused, resulting in a non-ideal encoding effect.

SUMMARY

Embodiments of the present disclosure provide a signal processing method and apparatus, which can avoid a waste of bits and improve encoding and decoding quality.

According to a first aspect, a signal processing method is provided, including: determining a total quantity of to-be-allocated bits corresponding to to-be-processed sub-bands of a current frame; implementing primary bit allocation on the to-be-processed sub-bands according to the total quantity of to-be-allocated bits, so as to obtain a quantity of primarily allocated bits of each sub-band of the to-be-processed sub-bands; performing, according to the quantity of primarily allocated bits of each sub-band, a primary information unit quantity determining operation for each sub-band that has undergone the primary bit allocation, so as to obtain a total quantity of surplus bits of the current frame and a quantity of information units corresponding to each sub-band of the to-be-processed sub-bands; selecting sub-bands for secondary bit allocation from the to-be-processed sub-bands according to a secondary bit allocation parameter, where the secondary bit allocation parameter includes at least one of a sub-band characteristic of each sub-band of the to-be-processed sub-bands or the total quantity of surplus bits; implementing secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation; and performing, according to the quantities of primarily allocated bits and the quantities of secondarily allocated bits of the sub-bands for secondary bit allocation, a secondary information unit quantity determining operation for each sub-band of the sub-bands for secondary bit allocation, so as to re-obtain a quantity of information units corresponding to each sub-band of the sub-bands for secondary bit allocation.

With reference to the first aspect, in a first possible implementation manner of the first aspect, the sub-band characteristic of each sub-band of the to-be-processed sub-bands includes at least one of a characteristic of a signal carried in the sub-band, a bit allocation state corresponding to the sub-band, or a frequency range of the sub-band.

With reference to the first aspect or any one of the foregoing possible implementation manner of the first aspect, in another possible implementation manner of the first aspect, the characteristic of the signal carried in the sub-band includes at least one of a type of the signal carried in the sub-band or an envelope value of the sub-band; and/or the bit allocation state corresponding to the sub-band includes at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band, where the average quantity of primary bits per unit bandwidth of the sub-band is determined according to the quantity of primarily allocated bits of the sub-band and bandwidth of the sub-band, and the quantity of primary bits per information unit of the sub-band is determined according to the quantity of primarily allocated bits of the sub-band and a quantity of primary information units of the sub-band, where the quantity of primary information units of the sub-band is obtained from the primary information unit quantity determining operation that the sub-band has undergone.

With reference to the first aspect or any one of the foregoing possible implementation manners of the first aspect, in another possible implementation manner of the first aspect, the type of the signal carried in the sub-band includes harmonic and/or non-harmonic.

With reference to the first aspect or any one of the foregoing possible implementation manners of the first aspect, in another possible implementation manner of the first aspect, the selecting sub-bands for secondary bit allocation from the to-be-processed sub-bands includes: determining a target sub-band set according to at least one of the sub-band characteristic of each sub-band of the to-be-processed sub-bands or the total quantity of surplus bits, and selecting the sub-bands for secondary bit allocation from the target sub-band set, where a sub-band in the target sub-band set belongs to the to-be-processed sub-bands.

With reference to the first aspect or any one of the foregoing possible implementation manners of the first aspect, in another possible implementation manner of the first aspect, the determining a target sub-band set includes: determining the target sub-band set according to a sub-band characteristic of each sub-band in m first sub-band sets and m predetermined conditions in a one-to-one correspondence with the m first sub-band sets, where m is an integer greater than or equal to 1, and a sub-band in the m first sub-band sets belongs to the to-be-processed sub-bands, where when all sub-band sets of the m first sub-band sets meet the corresponding predetermined conditions, a set formed by sub-bands that belong to all the m first sub-band sets is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

With reference to the first aspect or any one of the foregoing possible implementation manners of the first aspect, in another possible implementation manner of the first aspect, any predetermined condition of the m predetermined conditions includes at least one of the following conditions: that a coefficient-quantized sub-band exists in corresponding previous-frame sub-bands of a corresponding first sub-band set, that an average envelope value of sub-bands in a corresponding first sub-band set is greater than a first threshold, or that a sub-band carrying a signal of a harmonic type exists in a corresponding first sub-band set.

With reference to the first aspect or any one of the foregoing possible implementation manners of the first aspect, in another possible implementation manner of the first aspect, a frequency of a sub-band in the m first sub-band sets is higher than a frequency of a sub-band of the to-be-processed sub-bands other than the sub-bands in the m first sub-band sets.

With reference to the first aspect or any one of the foregoing possible implementation manners of the first aspect, in another possible implementation manner of the first aspect, the selecting the sub-bands for secondary bit allocation from the target sub-band set includes: selecting the sub-bands for secondary bit allocation from the target sub-band set according to at least one of an average quantity of primary bits per unit bandwidth of each sub-band, a quantity of primary bits per information unit of each sub-band, or a quantity of primarily allocated bits of each sub-band in the target sub-band set, where the average quantity of primary bits per unit bandwidth of the sub-band is determined according to the quantity of primarily allocated bits of the sub-band and bandwidth of the sub-band, and the quantity of primary bits per information unit of the sub-band is determined according to the quantity of primarily allocated bits of the sub-band and a quantity of primary information units of the sub-band, where the quantity of primary information units of the sub-band is obtained from the primary information unit quantity determining operation that the sub-band has undergone.

With reference to the first aspect or any one of the foregoing possible implementation manners of the first aspect, in another possible implementation manner of the first aspect, the selecting the sub-bands for secondary bit allocation from the target sub-band set includes: determining a sub-band with a smallest average quantity of primary bits per unit bandwidth, a sub-band with a smallest quantity of primary bits per information unit, or a sub-band with a smallest quantity of primarily allocated bits in the target sub-band set as a top-priority to-be-enhanced sub-band, where the top-priority to-be-enhanced sub-band belongs to the sub-bands for secondary bit allocation.

With reference to the first aspect or any one of the foregoing possible implementation manners of the first aspect, in another possible implementation manner of the first aspect, the selecting the sub-bands for secondary bit allocation from the target sub-band set further includes: when the total quantity of surplus bits is greater than a threshold $a_N$ and less than $a_{N+1}$, determining that N sub-bands for secondary bit allocation need to be selected, where $a_N$ and $a_{N+1}$ are respectively the $N^{th}$ threshold and the $(N+1)^{th}$ threshold of multiple thresholds sorted in ascending order; and when N is greater than or equal to 2, selecting N−1 sub-bands for secondary bit allocation from sub-bands in the target sub-band set other than the top-priority to-be-enhanced sub-band.

With reference to the first aspect or any one of the foregoing possible implementation manners of the first aspect, in another possible implementation manner of the first aspect, the selecting N−1 sub-bands for secondary bit allocation from sub-bands in the target sub-band set other than the top-priority to-be-enhanced sub-band includes: determining the N−1 sub-bands for secondary bit allocation based on the top-priority to-be-enhanced sub-band for allocation, where the N sub-bands for secondary bit allocation are successive in a frequency domain.

With reference to the first aspect or any one of the foregoing possible implementation manners of the first aspect, in another possible implementation manner of the first aspect, the selecting the sub-bands for secondary bit allocation from the target sub-band set further includes: when the total quantity of surplus bits is greater than a threshold, determining a second-priority to-be-enhanced sub-band from the target sub-band set, where the sub-bands for secondary bit allocation include the second-priority to-be-enhanced sub-band and the top-priority to-be-enhanced sub-band.

With reference to the first aspect or any one of the foregoing possible implementation manners of the first aspect, in another possible implementation manner of the first aspect, the selecting the sub-bands for secondary bit allocation from the target sub-band set further includes: determining a second-priority to-be-enhanced sub-band from the target sub-band set; and when the total quantity of surplus bits is greater than a threshold, determining that the second-priority to-be-enhanced sub-band belongs to the sub-bands for secondary bit allocation.

With reference to the first aspect or any one of the foregoing possible implementation manners of the first aspect, in another possible implementation manner of the first aspect, the determining a second-priority to-be-enhanced sub-band from the target sub-band set includes: determining a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band as the second-priority to-be-enhanced sub-band.

With reference to the first aspect or any one of the foregoing possible implementation manners of the first aspect, in another possible implementation manner of the first aspect, the implementing secondary bit allocation on the sub-bands for secondary bit allocation includes: when a quantity of sub-bands included in the sub-bands for secondary bit allocation is greater than or equal to 2, implementing secondary bit allocation on the sub-bands for secondary bit allocation according to a quantity of primary bits per information unit, an average quantity of primary bits per unit bandwidth, or a quantity of primarily allocated bits, of each sub-band of the sub-bands for secondary bit allocation.

With reference to the first aspect or any one of the foregoing possible implementation manners of the first aspect, in another possible implementation manner of the first aspect, the implementing primary bit allocation on the to-be-processed sub-bands according to the total quantity of to-be-allocated bits includes: implementing primary bit allocation on the to-be-processed sub-bands according to the total quantity of to-be-allocated bits and envelope values of sub-bands of the to-be-processed sub-bands.

With reference to the first aspect or any one of the foregoing possible implementation manners of the first aspect, in another possible implementation manner of the first aspect, when the method is executed by an encoder side, the method further includes: performing a quantization operation for each sub-band of the to-be-processed sub-bands according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and writing the quantized spectral coefficient into a bitstream and outputting the bitstream.

With reference to the first aspect or any one of the foregoing possible implementation manners of the first aspect, in another possible implementation manner of the first aspect, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and the method further includes: writing the at least one parameter into the bitstream.

With reference to the first aspect or any one of the foregoing possible implementation manners of the first aspect, in another possible implementation manner of the first aspect, when the method is executed by a decoder side, the method further includes: performing an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and acquiring an output signal according to the inverse quantized spectral coefficient.

With reference to the first aspect or any one of the foregoing possible implementation manners of the first aspect, in another possible implementation manner of the first aspect, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and the method further includes: acquiring the at least one parameter from a to-be-decoded bitstream.

According to a second aspect, a signal processing apparatus is provided, including: a total bit quantity determining unit, configured to determine a total quantity of to-be-allocated bits corresponding to to-be-processed sub-bands of a current frame; a primary bit allocation unit, configured to implement primary bit allocation on the to-be-processed sub-bands according to the total quantity of to-be-allocated bits, so as to obtain a quantity of primarily allocated bits of each sub-band of the to-be-processed sub-bands; a primary information unit quantity determining unit, configured to perform, according to the quantity of primarily allocated bits of each sub-band, a primary information unit quantity determining operation for each sub-band that has undergone the primary bit allocation, so as to obtain a total quantity of surplus bits of the current frame and a quantity of information units corresponding to each sub-band of the to-be-processed sub-bands; a sub-band selection unit, configured to select sub-bands for secondary bit allocation from the to-be-processed sub-bands according to a secondary bit allocation parameter, where the secondary bit allocation parameter includes at least one of a sub-band characteristic of each sub-band of the to-be-processed sub-bands or the total quantity of surplus bits; a secondary bit allocation unit, configured to implement secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation; and a secondary information unit quantity determining unit, configured to perform, according to the quantities of primarily allocated bits and the quantities of secondarily allocated bits of the sub-bands for secondary bit allocation, a secondary information unit quantity determining operation for each sub-band of the sub-bands for secondary bit allocation, so as to re-obtain a quantity of information units corresponding to each sub-band of the sub-bands for secondary bit allocation.

With reference to the second aspect, in a first possible implementation manner of the second aspect, the sub-band characteristic of each sub-band of the to-be-processed sub-bands includes at least one of a characteristic of a signal carried in the sub-band, a bit allocation state corresponding to the sub-band, or a frequency range of the sub-band.

With reference to the second aspect or any one of the foregoing possible implementation manner of the second aspect, in another possible implementation manner of the second aspect, the characteristic of the signal carried in the sub-band includes at least one of a type of the signal carried in the sub-band or an envelope value of the sub-band; and/or the bit allocation state corresponding to the sub-band includes at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band, where the average quantity of primary bits per unit bandwidth of the sub-band is determined according to the quantity of primarily allocated bits of the sub-band and bandwidth of the sub-band, and the quantity of primary bits per information unit of the sub-band is determined according to the quantity of primarily allocated bits of the sub-band and a quantity of primary information units of the sub-band, where the quantity of primary information units of the sub-band is obtained from the primary information unit quantity determining operation that the sub-band has undergone.

With reference to the second aspect or any one of the foregoing possible implementation manners of the second aspect, in another possible implementation manner of the second aspect, the type of the signal carried in the sub-band includes harmonic and/or non-harmonic.

With reference to the second aspect or any one of the foregoing possible implementation manners of the second aspect, in another possible implementation manner of the second aspect, the sub-band selection unit includes: a determining subunit, configured to determine a target sub-band set according to at least one of the sub-band characteristic of each sub-band of the to-be-processed sub-bands or the total quantity of surplus bits; and a selection subunit, configured to select the sub-bands for secondary bit allocation from the target sub-band set, where a sub-band in the target sub-band set belongs to the to-be-processed sub-bands.

With reference to the second aspect or any one of the foregoing possible implementation manners of the second aspect, in another possible implementation manner of the second aspect, the determining subunit is specifically configured to: determine the target sub-band set according to a sub-band characteristic of each sub-band in m first sub-band sets and m predetermined conditions in a one-to-one correspondence with the m first sub-band sets, where m is an integer greater than or equal to 1, and a sub-band in the m first sub-band sets belongs to the to-be-processed sub-bands, where when all sub-band sets of the m first sub-band sets meet the corresponding predetermined conditions, a set formed by sub-bands that belong to all the m first sub-band sets is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

With reference to the second aspect or any one of the foregoing possible implementation manners of the second aspect, in another possible implementation manner of the second aspect, any predetermined condition of the m predetermined conditions includes at least one of the following conditions: that a coefficient-quantized sub-band exists in corresponding previous-frame sub-bands of a corresponding first sub-band set, that an average envelope value of sub-bands in a corresponding first sub-band set is greater than a first threshold, or that a sub-band carrying a signal of a harmonic type exists in a corresponding first sub-band set.

With reference to the second aspect or any one of the foregoing possible implementation manners of the second aspect, in another possible implementation manner of the second aspect, a frequency of a sub-band in the m first sub-band sets is higher than a frequency of a sub-band of the to-be-processed sub-bands other than the sub-bands in the m first sub-band sets.

With reference to the second aspect or any one of the foregoing possible implementation manners of the second aspect, in another possible implementation manner of the second aspect, the selection subunit is specifically configured to: select the sub-bands for secondary bit allocation from the target sub-band set according to at least one of an average quantity of primary bits per unit bandwidth of each sub-band, a quantity of primary bits per information unit of each sub-band, or a quantity of primarily allocated bits of each sub-band in the target sub-band set.

With reference to the second aspect or any one of the foregoing possible implementation manners of the second aspect, in another possible implementation manner of the second aspect, the selection subunit is specifically configured to: determine a sub-band with a smallest average quantity of primary bits per unit bandwidth, a sub-band with a smallest quantity of primary bits per information unit, or a sub-band with a smallest quantity of primarily allocated bits in the target sub-band set as a top-priority to-be-enhanced sub-band, where the top-priority to-be-enhanced sub-band belongs to the sub-bands for secondary bit allocation.

With reference to the second aspect or any one of the foregoing possible implementation manners of the second aspect, in another possible implementation manner of the second aspect, the selection subunit is specifically configured to: when the total quantity of surplus bits is greater than a threshold $a_N$ and less than $a_{N+1}$, determine that N sub-bands for secondary bit allocation need to be selected, where $a_N$ and $a_{N+1}$ are respectively the $N^{th}$ threshold and the $(N+1)^{th}$ threshold of multiple thresholds sorted in ascending order; and when N is greater than or equal to 2, select N−1 sub-bands for secondary bit allocation from sub-bands in the target sub-band set other than the top-priority to-be-enhanced sub-band.

With reference to the second aspect or any one of the foregoing possible implementation manners of the second aspect, in another possible implementation manner of the second aspect, the selection subunit is specifically configured to: determine the N−1 sub-bands for secondary bit allocation based on the top-priority to-be-enhanced sub-band for allocation, where the N sub-bands for secondary bit allocation are successive in a frequency domain.

With reference to the second aspect or any one of the foregoing possible implementation manners of the second aspect, in another possible implementation manner of the second aspect, the selection subunit is specifically configured to: when the total quantity of surplus bits is greater than a threshold, determine a second-priority to-be-enhanced sub-band from the target sub-band set, where the sub-bands for secondary bit allocation include the second-priority to-be-enhanced sub-band and the top-priority to-be-enhanced sub-band.

With reference to the second aspect or any one of the foregoing possible implementation manners of the second aspect, in another possible implementation manner of the second aspect, the selection subunit is specifically configured to: determine a second-priority to-be-enhanced sub-band from the target sub-band set; and when the total quantity of surplus bits is greater than a threshold, determine that the second-priority to-be-enhanced sub-band belongs to the sub-bands for secondary bit allocation.

With reference to the second aspect or any one of the foregoing possible implementation manners of the second aspect, in another possible implementation manner of the second aspect, the selection subunit is specifically configured to: determine a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band as the second-priority to-be-enhanced sub-band.

With reference to the second aspect or any one of the foregoing possible implementation manners of the second aspect, in another possible implementation manner of the second aspect, the secondary bit allocation unit is specifically configured to: when a quantity of sub-bands included in the sub-bands for secondary bit allocation is greater than or equal to 2, implement secondary bit allocation on the sub-bands for secondary bit allocation according to a quantity of bits per information unit that is obtained from the primary information unit quantity determining operation, an average quantity of bits per unit bandwidth or a quantity of primarily allocated bits that is obtained from the primary information unit quantity determining operation, of each sub-band of the sub-bands for secondary bit allocation.

With reference to the second aspect or any one of the foregoing possible implementation manners of the second aspect, in another possible implementation manner of the second aspect, the primary bit allocation unit is specifically configured to: implement primary bit allocation on the to-be-processed sub-bands according to the total quantity of to-be-allocated bits and envelope values of sub-bands of the to-be-processed sub-bands.

With reference to the second aspect or any one of the foregoing possible implementation manners of the second aspect, in another possible implementation manner of the second aspect, the apparatus is a encoder, and the apparatus further includes: a quantization unit, configured to perform a quantization operation for each sub-band of the to-be-processed sub-bands according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and a transport unit, configured to write the quantized spectral coefficient into a bitstream and output the bitstream.

With reference to the second aspect or any one of the foregoing possible implementation manners of the second aspect, in another possible implementation manner of the second aspect, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and the transport unit is further configured to: write the at least one parameter into the bitstream.

With reference to the second aspect or any one of the foregoing possible implementation manners of the second aspect, in another possible implementation manner of the second aspect, the apparatus is a decoder, and the apparatus further includes: an inverse quantization unit, configured to perform an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and a first acquiring unit, configured to acquire an output signal according to the inverse quantized spectral coefficient.

With reference to the second aspect or any one of the foregoing possible implementation manners of the second aspect, in another possible implementation manner of the second aspect, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and the apparatus further includes: a second acquiring unit, configured to acquire the at least one parameter from a to-be-decoded bitstream.

According to a third aspect, a signal processing apparatus is provided, where the apparatus includes a memory and a processor, where the memory is configured to store program code; the processor is configured to call the program code stored in the memory to perform the following operations: determining a total quantity of to-be-allocated bits corresponding to to-be-processed sub-bands of a current frame; implementing primary bit allocation on the to-be-processed sub-bands according to the total quantity of to-be-allocated bits, so as to obtain a quantity of primarily allocated bits of each sub-band of the to-be-processed sub-bands; performing, according to the quantity of primarily allocated bits of each sub-band, a primary information unit quantity determining operation for each sub-band that has undergone the primary bit allocation, so as to obtain a total quantity of surplus bits of the current frame and a quantity of information units corresponding to each sub-band of the to-be-processed sub-bands; selecting sub-bands for secondary bit allocation from the to-be-processed sub-bands according to a secondary bit allocation parameter, where the secondary bit allocation parameter includes at least one of a sub-band characteristic of each sub-band of the to-be-processed sub-bands or the total quantity of surplus bits; implementing secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation; and performing, according to the quantities of primarily allocated bits and the quantities of secondarily allocated bits of the sub-bands for secondary bit allocation, a secondary information unit quantity determining operation for each sub-band of the sub-bands for secondary bit allocation, so as to re-obtain a quantity of information units corresponding to each sub-band of the sub-bands for secondary bit allocation.

With reference to the third aspect, in a first possible implementation manner of the third aspect, the sub-band characteristic of each sub-band of the to-be-processed sub-bands includes at least one of a characteristic of a signal carried in the sub-band, a bit allocation state corresponding to the sub-band, or a frequency range of the sub-band.

With reference to the third aspect or any one of the foregoing possible implementation manner of the third aspect, in another possible implementation manner of the third aspect, the characteristic of the signal carried in the sub-band includes at least one of a type of the signal carried in the sub-band or an envelope value of the sub-band; and/or the bit allocation state corresponding to the sub-band includes at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band, where the average quantity of primary bits per unit bandwidth of the sub-band is determined according to the quantity of primarily allocated bits of the sub-band and bandwidth of the sub-band, and the quantity of primary bits per information unit of the sub-band is determined according to the quantity of primarily allocated bits of the sub-band and a quantity of primary information units of the sub-band, where the quantity of primary information units of the sub-band is obtained from the primary information unit quantity determining operation that the sub-band has undergone.

With reference to the third aspect or any one of the foregoing possible implementation manners of the third aspect, in another possible implementation manner of the third aspect, the type of the signal carried in the sub-band includes harmonic and/or non-harmonic.

With reference to the third aspect or any one of the foregoing possible implementation manners of the third aspect, in another possible implementation manner of the third aspect, the processor is configured to call the program code stored in the memory to specifically perform the following operations: determining a target sub-band set according to at least one of the sub-band characteristic of each sub-band of the to-be-processed sub-bands or the total quantity of surplus bits, and selecting the sub-bands for secondary bit allocation from the target sub-band set, where a sub-band in the target sub-band set belongs to the to-be-processed sub-bands.

With reference to the third aspect or any one of the foregoing possible implementation manners of the third aspect, in another possible implementation manner of the third aspect, the processor is configured to call the program code stored in the memory to specifically perform the following operation: determining the target sub-band set according to a sub-band characteristic of each sub-band in m first sub-band sets and m predetermined conditions in a one-to-one correspondence with the m first sub-band sets, where m is an integer greater than or equal to 1, and a sub-band in the m first sub-band sets belongs to the to-be-processed sub-bands, where when all sub-band sets of the m first sub-band sets meet the corresponding predetermined conditions, a set formed by sub-bands that belong to all the m first sub-band sets is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

With reference to the third aspect or any one of the foregoing possible implementation manners of the third aspect, in another possible implementation manner of the third aspect, any predetermined condition of the m predetermined conditions includes at least one of the following conditions: that a coefficient-quantized sub-band exists in corresponding previous-frame sub-bands of a corresponding first sub-band set, that an average envelope value of sub-bands in a corresponding first sub-band set is greater than a first threshold, or that a sub-band carrying a signal of a harmonic type exists in a corresponding first sub-band set.

With reference to the third aspect or any one of the foregoing possible implementation manners of the third aspect, in another possible implementation manner of the third aspect, a frequency of a sub-band in the m first sub-band sets is higher than a frequency of a sub-band of the to-be-processed sub-bands other than the sub-bands in the m first sub-band sets.

With reference to the third aspect or any one of the foregoing possible implementation manners of the third aspect, in another possible implementation manner of the third aspect, the processor is configured to call the program code stored in the memory to specifically perform the following operation: selecting the sub-bands for secondary bit allocation from the target sub-band set according to at least one of an average quantity of primary bits per unit bandwidth of each sub-band, a quantity of primary bits per information unit of each sub-band, or a quantity of primarily allocated bits of each sub-band in the target sub-band set.

With reference to the third aspect or any one of the foregoing possible implementation manners of the third aspect, in another possible implementation manner of the third aspect, the processor is configured to call the program code stored in the memory to specifically perform the following operation: determining a sub-band with a smallest average quantity of primary bits per unit bandwidth, a sub-band with a smallest quantity of primary bits per information unit, or a sub-band with a smallest quantity of primarily allocated bits in the target sub-band set as a top-priority to-be-enhanced sub-band, where the top-priority to-be-enhanced sub-band belongs to the sub-bands for secondary bit allocation.

With reference to the third aspect or any one of the foregoing possible implementation manners of the third aspect, in another possible implementation manner of the third aspect, the processor is configured to call the program code stored in the memory to specifically perform the following operations: when the total quantity of surplus bits is greater than a threshold $a_N$ and less than $a_{N+1}$, determining that N sub-bands for secondary bit allocation need to be selected, where $a_N$ and $a_{N+1}$ are respectively the $N^{th}$ threshold and the $(N+1)^{th}$ threshold of multiple thresholds sorted in ascending order; and when N is greater than or equal to 2, selecting N−1 sub-bands for secondary bit allocation from sub-bands in the target sub-band set other than the top-priority to-be-enhanced sub-band.

With reference to the third aspect or any one of the foregoing possible implementation manners of the third aspect, in another possible implementation manner of the third aspect, the processor is configured to call the program code stored in the memory to specifically perform the following operation: determining the N−1 sub-bands for secondary bit allocation based on the top-priority to-be-enhanced sub-band for allocation, where the N sub-bands for secondary bit allocation are successive in a frequency domain.

With reference to the third aspect or any one of the foregoing possible implementation manners of the third aspect, in another possible implementation manner of the third aspect, the processor is configured to call the program code stored in the memory to specifically perform the following operation: when the total quantity of surplus bits is greater than a threshold, determining a second-priority to-be-enhanced sub-band from the target sub-band set, where the sub-bands for secondary bit allocation include the second-priority to-be-enhanced sub-band and the top-priority to-be-enhanced sub-band.

With reference to the third aspect or any one of the foregoing possible implementation manners of the third aspect, in another possible implementation manner of the third aspect, the processor is configured to call the program code stored in the memory to specifically perform the following operations: determining a second-priority to-be-enhanced sub-band from the target sub-band set; and when the total quantity of surplus bits is greater than a threshold, determining that the second-priority to-be-enhanced sub-band belongs to the sub-bands for secondary bit allocation.

With reference to the third aspect or any one of the foregoing possible implementation manners of the third aspect, in another possible implementation manner of the third aspect, the processor is configured to call the program code stored in the memory to specifically perform the following operation: determining a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band as the second-priority to-be-enhanced sub-band.

With reference to the third aspect or any one of the foregoing possible implementation manners of the third aspect, in another possible implementation manner of the third aspect, the processor is configured to call the program code stored in the memory to specifically perform the following operation: when a quantity of sub-bands included in the sub-bands for secondary bit allocation is greater than or equal to 2, implementing secondary bit allocation on the sub-bands for secondary bit allocation according to a quantity of primary bits per information unit, an average quantity of primary bits per unit bandwidth, or a quantity of primarily allocated bits, of each sub-band of the sub-bands for secondary bit allocation.

With reference to the third aspect or any one of the foregoing possible implementation manners of the third aspect, in another possible implementation manner of the third aspect, the processor is configured to call the program code stored in the memory to specifically perform the following operation: implementing primary bit allocation on the to-be-processed sub-bands according to the total quantity of to-be-allocated bits and envelope values of sub-bands of the to-be-processed sub-bands.

With reference to the third aspect or any one of the foregoing possible implementation manners of the third aspect, in another possible implementation manner of the third aspect, the apparatus is an encoder, and the processor is configured to call the program code stored in the memory to further perform the following operations: performing a quantization operation for each sub-band of the to-be-processed sub-bands according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and writing the quantized spectral coefficient into a bitstream and outputting the bitstream.

With reference to the third aspect or any one of the foregoing possible implementation manners of the third aspect, in another possible implementation manner of the third aspect, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and when the apparatus is an encoder, the processor is configured to call the program code stored in the memory to further perform the following operation: writing the at least one parameter into the bitstream.

With reference to the third aspect or any one of the foregoing possible implementation manners of the third aspect, in another possible implementation manner of the third aspect, the apparatus is a decoder, and the processor is configured to call the program code stored in the memory to further perform the following operations: performing an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and acquiring an output signal according to the inverse quantized spectral coefficient.

With reference to the third aspect or any one of the foregoing possible implementation manners of the third aspect, in another possible implementation manner of the third aspect, when the apparatus is a decoder, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands; and when the apparatus is a decoder, the processor is configured to call the program code stored in the memory to further perform the following operation: acquiring the at least one parameter from a to-be-decoded bitstream.

Therefore, in the embodiments of the present disclosure, primary bit allocation is first performed for to-be-processed sub-bands according to a total quantity of to-be-allocated bits of a current frame, so as to obtain a quantity of primarily allocated bits of each sub-band; a primary information unit quantity determining operation is performed for a sub-band that has undergone the primary bit allocation, so as to obtain a quantity of information units corresponding to each sub-band of the to-be-processed sub-bands and a total quantity of surplus bits of the current frame; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

BRIEF DESCRIPTION OF DRAWINGS

To describe the technical solutions in the embodiments of the present disclosure more clearly, the following briefly describes the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
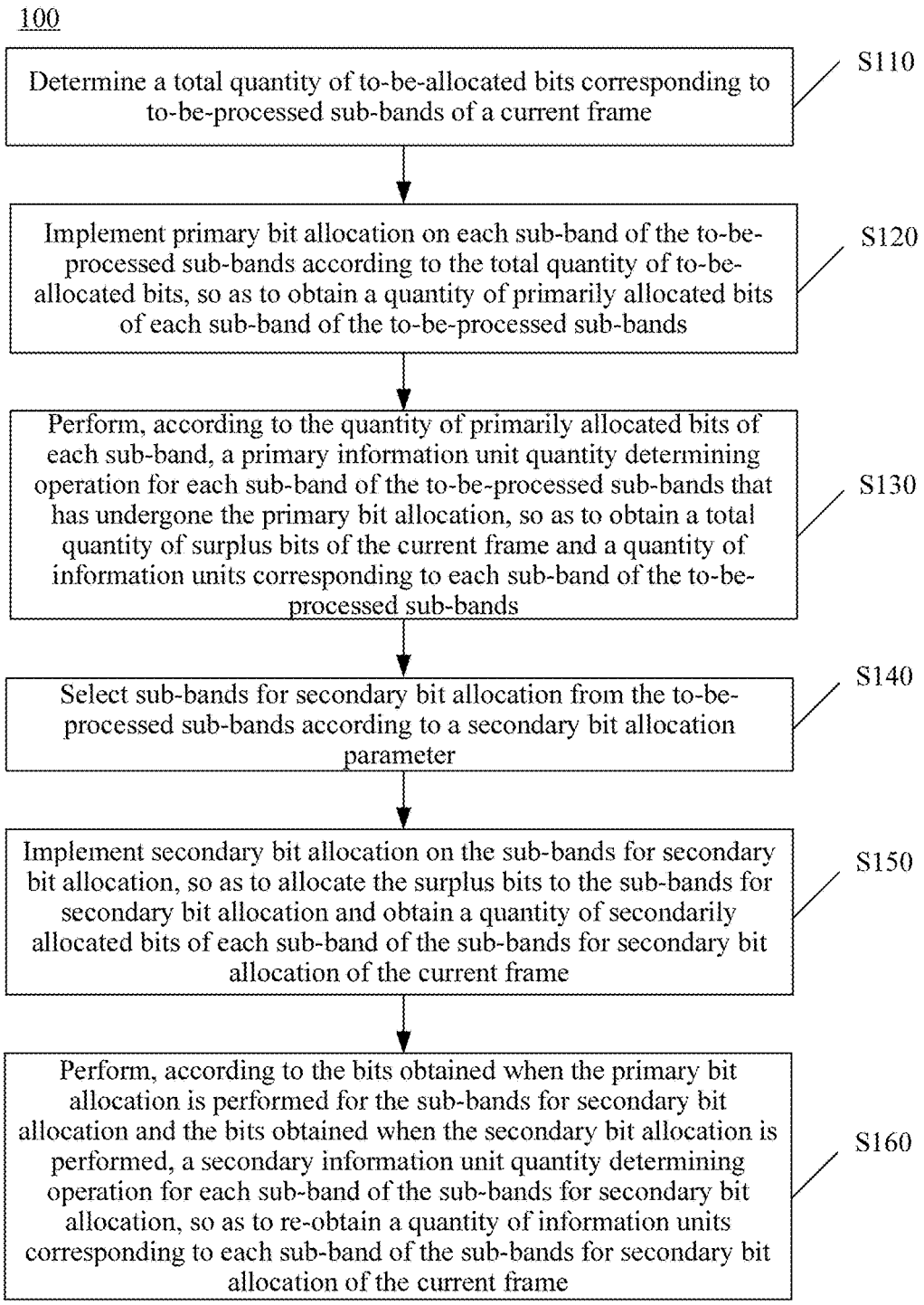
FIG. 1 is a schematic flowchart of a signal processing method according to an embodiment of the present disclosure.

FIG. 1 is a schematic flowchart of a signal processing method 100 according to an embodiment of the present disclosure. As shown in FIG. 1, the method 100 includes:

S110. Determine a total quantity of to-be-allocated bits corresponding to to-be-processed sub-bands of a current frame.

S120. Implement primary bit allocation on each sub-band of the to-be-processed sub-bands according to the total quantity of to-be-allocated bits, so as to obtain a quantity of primarily allocated bits of each sub-band of the to-be-processed sub-bands.

S130. Perform, according to the quantity of primarily allocated bits of each sub-band, a primary information unit quantity determining operation for each sub-band of the to-be-processed sub-bands that has undergone the primary bit allocation, so as to obtain a total quantity of surplus bits of the current frame and a quantity of information units corresponding to each sub-band of the to-be-processed sub-bands.

S140. Select sub-bands for secondary bit allocation from the to-be-processed sub-bands according to a secondary bit allocation parameter, where the secondary bit allocation parameter includes at least one of the total quantity of surplus bits or a sub-band characteristic of each sub-band of the to-be-processed sub-bands.

S150. Implement secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation.

S160. Perform, according to the bits obtained when the primary bit allocation is performed for the sub-bands for secondary bit allocation and the bits obtained when the secondary bit allocation is performed, a secondary information unit quantity determining operation for each sub-band of the sub-bands for secondary bit allocation, so as to re-obtain a quantity of information units corresponding to each sub-band of the sub-bands for secondary bit allocation.

Specifically, when the bit allocation is performed for the to-be-processed sub-bands of the current frame, the total quantity of to-be-allocated bits corresponding to the to-be-processed sub-bands may be determined; the primary bit allocation is performed for the to-be-processed sub-bands according to the total quantity of to-be-allocated bits, so as to obtain the quantity of primarily allocated bits of each sub-band, where the primary bit allocation may be performed for each sub-band according to an envelope value of each sub-band; according to the quantity of primarily allocated bits of each sub-band, the primary information unit quantity determining operation is performed for each sub-band that has undergone the primary bit allocation, and after the primary information unit quantity determining operation is performed for all sub-bands, the quantity of information units corresponding to each sub-band and the total quantity of surplus bits are obtained; the sub-bands for secondary bit allocation are selected from the to-be-processed sub-bands according to the secondary bit allocation parameter, and specifically, according to the sub-band characteristic of each sub-band of the to-be-processed sub-bands and/or the total quantity of surplus bits; the secondary bit allocation is performed for the selected sub-bands for secondary bit allocation, that is, the surplus bits are allocated to the sub-bands for secondary bit allocation; then, the secondary information unit quantity determining operation is performed for each sub-band of the sub-bands for secondary bit allocation according to the quantities of primarily allocated bits and the quantities of secondarily allocated bits of the sub-bands for secondary bit allocation, so as to re-obtain the quantity of information units corresponding to each sub-band of the sub-bands for secondary bit allocation. Therefore, a subsequent operation may be performed according to the quantity of information units corresponding to each sub-band of the to-be-processed sub-bands. For example, for an encoder side, a quantization operation may be performed according to the quantity of information units corresponding to each sub-band, and for a decoder side, an inverse quantization operation may be performed according to the quantity of information units corresponding to each sub-band.

It should be understood that, on the encoder side, the to-be-processed sub-bands in this embodiment of the present disclosure may be referred to as to-be-encoded sub-bands, and on the decoder side, the to-be-processed sub-bands in this embodiment of the present disclosure may be referred to as to-be-decoded sub-bands.

It should be understood that the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation.

It should be understood that, in this embodiment of the present disclosure, the quantity of information units corresponding to each sub-band and a quantity of surplus bits corresponding to each sub-band may be obtained by performing a primary information unit quantity determining operation for each sub-band of the to-be-processed sub-bands, where a sum of a quantity of bits occupied by the information units corresponding to each sub-band and the quantity of surplus bits corresponding to each sub-band is the quantity of primarily allocated bits of each sub-band, and the quantity of surplus bits corresponding to each sub-band is insufficient for encoding one information unit; then, the total quantity of surplus bits of the current frame may be obtained by summing up surplus bits corresponding to all sub-bands of the to-be-processed sub-bands of the current frame, and the total surplus bits of the current frame are allocated to the sub-bands for secondary bit allocation of the to-be-processed sub-bands of the current frame.

It should be further understood that an information unit in this embodiment of the present disclosure is a unit for encoding, an information unit quantity determining operation is a specific process of an encoding or decoding operation, and the determining may be specifically performed according to a quantity of allocated bits. Certainly, for different encoding methods, an information unit may have different names. For example, in some encoding methods, an information unit is referred to as a pulse. Whatever name is used shall fall within the protection scope of the present disclosure, provided that the essence is the same as that in the present disclosure.

Therefore, in this embodiment of the present disclosure, primary bit allocation is first performed for to-be-processed sub-bands of a current frame according to a total quantity of to-be-allocated bits, so as to obtain a quantity of primarily allocated bits of each sub-band; a primary information unit quantity determining operation is performed for a sub-band that has undergone the primary bit allocation, so as to obtain a quantity of information units corresponding to each sub-band of the to-be-processed sub-bands and a total quantity of surplus bits; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

In this embodiment of the present disclosure, the secondary bit allocation parameter may include at least one of the total quantity of surplus bits or a sub-band characteristic of each sub-band of the to-be-processed sub-bands.

Optionally, the sub-band characteristic of each sub-band of the to-be-processed sub-bands may include at least one of a characteristic of a signal carried in the sub-band, a bit allocation state corresponding to the sub-band, or a frequency range of the sub-band. Alternatively, the sub-band characteristic of each sub-band may be merely a number or the like of a sub-band.

Optionally, the characteristic of the signal carried in the sub-band may include at least one of a type of the signal carried in the sub-band or an envelope value, where the type of the carried signal may include harmonic and/or non-harmonic; and/or the bit allocation state corresponding to the sub-band may include at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band.

Optionally, the coefficient quantization state of the corresponding previous-frame sub-band of the sub-band may be a situation whether the corresponding previous-frame sub-band of the sub-band is coefficient-quantized, and specifically, may be determined based on whether a bit is allocated to the corresponding previous-frame sub-band of the sub-band, where whether a bit is allocated to the corresponding previous-frame sub-band may be determined comprehensively according to the primary bit allocation and the secondary bit allocation. It may be understood that a bit is allocated to the corresponding previous-frame sub-band provided that a bit is allocated (no matter whether being allocated when the primary bit allocation is performed or allocated when the secondary bit allocation is performed).

In this embodiment of the present disclosure, an average quantity of primary bits per unit bandwidth of any sub-band is determined according to a quantity of primarily allocated bits of the any sub-band and bandwidth of the any sub-band.

The average quantity of primary bits per unit bandwidth of the sub-band may be determined according to the following formula:

$$\text{aver_bit}[k_i] = \frac{Rk_1[k_i]}{\text{bandwidth}[k_i]},$$

where $Rk_1[k_i]$ indicates a quantity of primarily allocated bits of a sub-band $k_i$, and bandwidth$[k_i]$ indicates bandwidth of the sub-band.

A quantity of primary bits per information unit of any sub-band is determined according to a quantity of primarily allocated bits of the any sub-band and a quantity of primary information units of the any sub-band, where the quantity of primary information units of the any sub-band is obtained from a primary information unit quantity determining operation is performed for the any sub-band.

The quantity of primary bits per information unit of the sub-band may be determined according to the following formula:

$$\text{Rk_pulse}[k_i] = \frac{Rk_1[k_i]}{npluse[k_i]},$$

where $Rk_1[k_i]$ indicates a quantity $Rk_1[k_i]$ of primarily allocated bits of a sub-band $k_i$, and npluse$[k_i]$ indicates a quantity of information units (that is, a quantity of primary information units of the sub-band) that is obtained from a primary information unit quantity determining operation is performed for the sub-band $k_i$.

It should be understood that this embodiment of the present disclosure is described based on a fact that bandwidth occupied by a signal is divided into multiple sub-bands in each frame, and a current-frame sub-band and a corresponding previous-frame sub-band of the sub-band (that is, the previous frame corresponding to the sub-band) are the same in terms of frequency. In some scenarios, for different frames, even if sub-bands with a same frequency range are referred to as one sub-band. Any used technical solution shall also fall within the protection scope of the present disclosure provided that the essence of the used technical solution is the same as that in the present disclosure.

In this embodiment of the present disclosure, in S130, the selecting sub-bands for secondary bit allocation from the to-be-processed sub-bands may include:

determining a target sub-band set according to at least one of the total quantity of surplus bits or the sub-band characteristic of each sub-band of the to-be-processed sub-bands, and selecting the sub-bands for secondary bit allocation from the target sub-band set, where a sub-band in the target sub-band set belongs to the to-be-processed sub-bands.

Specifically, the target sub-band set is determined according to a sub-band characteristic of m first sub-band sets and m predetermined conditions in a one-to-one correspondence with the m first sub-band sets, where m is an integer greater than or equal to 1, where when all sub-band sets of the m first sub-band sets meet the corresponding predetermined conditions, a set formed by sub-bands that belong to all the m first sub-band sets (when m is greater than or equal to 2, the set is an intersection of the m first sub-band sets) is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

It should be understood that a one-to-one correspondence between the m first sub-band sets and the m predetermined conditions means that each sub-band set of the m first sub-band sets is corresponding to one predetermined condition, and the sub-band sets are corresponding to different predetermined conditions.

Optionally, any predetermined condition of the m predetermined conditions includes at least one of the following conditions:

that a coefficient-quantized sub-band exists in corresponding previous-frame sub-bands of a corresponding first sub-band set, that an average envelope value of sub-bands in a corresponding first sub-band set is greater than a first threshold, or that a sub-band carrying a signal of a harmonic type exists in a corresponding first sub-band set.

Optionally, the first threshold may be specifically determined according to an average envelope value of sub-bands outside the first sub-band set. For example, the determining may be performed according to a formula $$\theta = \frac{1}{3} \cdot \frac{\sum_{i=0}^{BANDS-J-1} Ep[i]}{\text{BANDS} - J},$$

where Ep[i] indicates an envelope value of a sub-band i, BANDS is a quantity of to-be-processed sub-bands, the first sub-band set includes a total of J sub-bands, Ep[i] indicates an envelope value of a sub-band i, and $$\sum_{i=0}^{BANDS-J-1} Ep[i]$$

indicates a sum of envelope values of sub-bands other than the J sub-bands.

Optionally, a frequency of a sub-band in the m first sub-band sets is higher than a frequency of a sub-band of the to-be-processed sub-bands other than the sub-bands in the m first sub-band sets. That is, whether a high-frequency sub-band meets a condition is first determined; if the corresponding condition is met, sub-bands for secondary bit allocation are selected from the high-frequency ones; or if the corresponding condition is not met, sub-bands for secondary bit allocation are selected from the low-frequency ones.

Optionally, in this embodiment of the present disclosure, the m first sub-band sets may be preconfigured, or may be selected by an encoding/decoding device from to-be-processed sub-band sets.

Optionally, in this embodiment of the present disclosure, no matter whether the m first sub-band sets are preconfigured, or selected by an encoding/decoding device, when the m first sub-band sets are selected, the m first sub-band sets may be determined according to bandwidth occupied by a to-be-encoded or to-be-decoded signal. For example, the occupied bandwidth is narrowband bandwidth (for example, the bandwidth is 4 kHz), a set formed by sub-bands with a bandwidth greater than 2 kHz may be determined as one first sub-band set, and a set formed by sub-bands with a bandwidth greater than 3 kHz may be determined as another first sub-band set. For another example, the occupied bandwidth is wideband bandwidth (for example, the bandwidth is 8 kHz), a set formed by sub-bands with a bandwidth greater than 5 kHz may be determined as one first sub-band set, and a set formed by sub-bands with a bandwidth greater than 6 kHz may be determined as another first sub-band set.

It should be understood that, in this embodiment of the present disclosure, the target sub-band set may be directly selected from the to-be-processed sub-bands according to a predetermined condition. In this case, the predetermined condition may be that a sub-band carries a signal of a harmonic type, and then all sub-bands carrying signals of a harmonic type may be determined to form the target sub-band set; or the predetermined condition may be that a coefficient-quantized sub-band exists in corresponding previous-frame sub-bands of the to-be-processed sub-bands, and then all sub-bands of the current frame whose corresponding previous-frame sub-bands are coefficient-quantized may be determined to form the target sub-band set; or the predetermined condition may be that an envelope value of a sub-band of the current frame is greater than a threshold, and then all sub-bands of the current frame whose envelope values are greater than the threshold may be determined to form the target sub-band set, where the threshold may be determined according to an average envelope value of all sub-bands of the current frame, for example, the average envelope value may be directly determined as the threshold, or 4/5 of the average envelope value is determined as the threshold; or the predetermined condition includes at least two of the foregoing predetermined conditions, and then all sub-bands meeting the at least two conditions are determined to form the target sub-band set.

In this embodiment of the present disclosure, after the target sub-band set is determined, the sub-bands for secondary bit allocation may be selected from the target sub-band set, where the sub-bands for secondary bit allocation may be selected from the target sub-band set according to at least one of an average quantity of primary bits per unit bandwidth of each sub-band, a quantity of primary bits per information unit of each sub-band, or a quantity of primarily allocated bits of each sub-band in the target sub-band set.

Specifically, a top-priority to-be-enhanced sub-band may be first determined, where a sub-band with a smallest average quantity of primary bits per unit bandwidth, a sub-band with a smallest quantity of bits per information unit, or a sub-band with a smallest quantity of primarily allocated bits in the target sub-band set may be determined as the top-priority to-be-enhanced sub-band, where the smallest quantity of bits per information unit and the smallest quantity of primarily allocated bits are obtained by the primary information unit quantity determining operation, and the top-priority to-be-enhanced sub-band belongs to the sub-bands for secondary bit allocation. Optionally, all the surplus bits may be directly allocated to the top-priority to-be-enhanced sub-band, that is, the sub-bands for secondary allocation may include only the top-priority to-be-enhanced sub-band, or another sub-band that belongs to the sub-bands for secondary bit allocation may be further selected. Specifically, determining whether to select another sub-band for secondary bit allocation and selecting another sub-band for secondary bit allocation may be implemented in the following two manners:

In a first implementation manner, when the total quantity of surplus bits is greater than a threshold $a_N$ and less than $a_{N+1}$, it is determined that N sub-bands for secondary bit allocation need to be selected, where $a_N$ and $a_{N+1}$ are respectively the $N^{th}$ threshold and the $(N+1)^{th}$ threshold of multiple thresholds sorted in ascending order. When N is greater than or equal to 2, N−1 sub-bands for secondary bit allocation are selected from sub-bands in the target sub-band set other than the top-priority to-be-enhanced sub-band. Certainly, when N is equal to 1, there is no need to further select another sub-band for secondary bit allocation.

In this embodiment of the present disclosure, multiple refers to two or more than two. For example, multiple thresholds refer to two or more than two thresholds.

Optionally, in this embodiment of the present disclosure, the thresholds may be determined according to bandwidth occupied by a to-be-encoded or to-be-decoded signal and/or bandwidth of the top-priority to-be-enhanced sub-band. Optionally, the thresholds are in a positive correlation with bandwidth occupied by a to-be-encoded or to-be-decoded signal and/or bandwidth of the top-priority to-be-enhanced sub-band.

Optionally, the other N−1 sub-bands for secondary bit allocation may be selected based on the top-priority to-be-enhanced sub-band. To better maintain continuity of a spectrum, the N sub-bands for secondary bit allocation are successive in a frequency domain.

Specifically, when N is 2, a sub-band with a smaller average quantity of primary bits per unit bandwidth, a sub-band with a smaller quantity of bits per information unit, or a sub-band with a smaller quantity of primarily allocated bits, of two sub-bands adjacent to the top-priority to-be-enhanced sub-band may be determined as another sub-band for secondary bit allocation, where the smaller quantity of bits per information unit and the smaller quantity of primarily allocated bits are obtained by the primary information unit quantity determining operation. When N=3, two sub-bands k+1 and k−1 adjacent to the top-priority to-be-enhanced sub-band k may be determined as the sub-bands for secondary bit allocation. If N=4, sub-bands k+1 and k−1 may be determined as sub-bands for secondary bit allocation, and a sub-band with a smaller average quantity of primary bits per unit bandwidth, a sub-band with a smaller quantity of bits per information unit, or a sub-band with a smaller quantity of primarily allocated bits, of sub-bands k+2 and k−2 adjacent to sub-bands k+1 and k−1 may be determined as a sub-band for secondary bit allocation, where the smaller quantity of bits per information unit and the smaller quantity of primarily allocated bits are obtained from the primary information unit quantity determining operation. If N≥5, selection may also be further performed according to a manner similar to the foregoing manner. It should be understood that the tags k, k+1, k−1, and the like of the foregoing sub-bands are merely for ease of description and shall not be construed as a limitation on the present disclosure.

Certainly, in this embodiment of the present disclosure, there may be no need to ensure that the N sub-bands for secondary bit allocation are successive in a frequency domain. For example, N sub-bands with smaller average quantities of primary bits per unit bandwidth in the target sub-band set may be determined as the sub-bands for secondary bit allocation according to average quantities of primary bits per unit bandwidth of all sub-bands; or N sub-bands with smaller quantities of bits per information unit in the target sub-band set may be determined as the sub-bands for secondary bit allocation according to quantities of primary bits per information unit of all sub-bands; or N sub-bands with quantities of primarily allocated bits in the target sub-band set may be determined as the sub-bands for secondary bit allocation according to quantities of primarily allocated bits of all sub-bands. Alternatively, one sub-band is selected from two sub-bands k+1 and k−1 adjacent to the top-priority to-be-enhanced sub-band k, and one sub-band is selected from sub-bands k+2 and k−2, and so on, until all N sub-bands are selected.

In a second implementation manner, when the total quantity of surplus bits is greater than a threshold a, it may be determined that a second-priority to-be-enhanced sub-band needs to be selected, and then, the second-priority to-be-enhanced sub-band is determined from the target sub-band set, where the sub-bands for secondary bit allocation include the top-priority to-be-enhanced sub-band and the second-priority to-be-enhanced sub-band. Alternatively, the second-priority to-be-enhanced sub-band may be first determined from the target sub-band set, and then it is determined whether the total quantity of surplus bits is greater than a threshold a; if the total quantity of surplus bits is greater than the threshold a, it may be determined that the second-priority to-be-enhanced sub-band belongs to the sub-bands for secondary bit allocation; or if the total quantity of surplus bits is not greater than the threshold a, the second-priority to-be-enhanced sub-band does not belong to the sub-bands for secondary bit allocation. Optionally, the top-priority to-be-enhanced sub-band and the second-priority to-be-enhanced sub-band are successive in a frequency domain, and specifically, a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band may be determined as the second-priority to-be-enhanced sub-band.

Optionally, the threshold a may be determined according to bandwidth of the top-priority to-be-enhanced sub-band and/or bandwidth occupied by a to-be-encoded or to-be-decoded signal. Optionally, the threshold a is in a positive correlation with bandwidth of the top-priority to-be-enhanced sub-band and/or bandwidth occupied by a to-be-encoded or to-be-decoded signal. For example, when bandwidth of the to-be-encoded signal is 4 kHz, the threshold may be set to 8, or when bandwidth of the to-be-encoded signal is 8 kHz, the threshold a may be set to 12.

Certainly, the top-priority to-be-enhanced sub-band and the second-priority to-be-enhanced sub-band in this embodiment of the present disclosure may not necessarily be sub-bands that are successive in a frequency domain. For example, two sub-bands with smaller average quantities of bits per unit bandwidth in the target sub-band set are determined as the top-priority to-be-enhanced sub-band and the second-priority to-be-enhanced sub-band according to average quantities of bits per unit bandwidth of all sub-bands, where the average quantities of the bits per unit bandwidth of all the sub-bands are obtained from the primary information unit quantity determining operation; or two sub-bands with smaller quantities of bits per information unit in the target sub-band set are determined as the top-priority to-be-enhanced sub-band and the second-priority to-be-enhanced sub-band according to quantities of primary bits per information unit of all sub-bands; or two sub-bands with quantities of primarily allocated bits in the target sub-band set are determined as the top-priority to-be-enhanced sub-band and the second-priority to-be-enhanced sub-band according to quantities of primarily allocated bits of all sub-bands.

It should be understood that, in this embodiment of the present disclosure, the target sub-band set may alternatively not be determined, and the sub-bands for secondary bit allocation are selected directly from the to-be-processed sub-bands, where a quantity of the sub-bands for secondary bit allocation that need to be selected may be determined according to the total quantity of surplus bits. For example, h sub-bands with the smallest quantities of primarily allocated bits are determined as the sub-bands for secondary bit allocation (inclusive of h sub-bands). In the present disclosure, all sub-bands with a characteristic may also be determined as the sub-bands for secondary bit allocation. For example, sub-bands of the current frame whose corresponding previous-frame sub-bands are coefficient-quantized are determined as the sub-bands for secondary bit allocation, and so on.

The foregoing describes how the sub-bands for secondary bit allocation are determined. After the sub-bands for secondary bit allocation are determined, the surplus bits may be allocated to the sub-bands for secondary bit allocation. The following specifically describes how the surplus bits are allocated to the sub-bands for secondary bit allocation.

In this embodiment of the present disclosure, when a quantity of sub-bands included in the sub-bands for secondary bit allocation is 1, all the surplus bits may be directly allocated to the one sub-band for secondary bit allocation.

In this embodiment of the present disclosure, when the sub-bands for secondary bit allocation include at least two sub-bands, the secondary bit allocation may be performed for each sub-band of the sub-bands for secondary bit allocation according to a quantity of primary bits per information unit, an average quantity of bits per unit bandwidth in the primary bit allocation, or the quantity of primarily allocated bits, of each sub-band of the sub-bands for secondary bit allocation. Specifically, the surplus bits may be allocated to the sub-bands for secondary bit allocation according to proportions. Specifically, there may be the following manners for determining an allocation proportion. In the following manners, it is assumed that there are a total of N sub-bands $k_1$, $k_2$, . . . , and $k_N$, and an allocation proportion $\beta_i$ for a sub-band $k_i$ may be determined in the following manners:

$$\beta_i = \frac{\text{aver_bit}[k_i]}{\text{aver_bit}[k_1] + \text{aver_bit}[k_2] + \ldots + \text{aver_bit}[k_N]} \tag{1}$$

where aver_bit[$k_i$] indicates an average quantity of primary bits per unit bandwidth of the sub-band $k_i$, that is, $$\text{aver_bit}[k_i] = \frac{Rk_1\,[k_i]}{\text{bandwidth}[k_i]},$$

where $Rk_1[k_i]$ indicates a quantity of primarily allocated bits of the sub-band $k_i$, and bandwidth[$k_i$] indicates bandwidth of the sub-band $k_i$.

$$\beta_i = \frac{\text{Rk_pulse}[k_i]}{\text{Rk_pulse}[k_1] + \text{Rk_pulse}[k_2] + \ldots + \text{Rk_pulse}[k_N]} \tag{2}$$

where Rk_pulse[$k_i$] indicates a quantity of primary bits per information unit of the sub-band $k_i$, that is, $$\text{Rk_pulse}[k_i] = \frac{Rk_1[k_i]}{npluse[k_i]},$$

where $Rk_1[k_i]$ indicates a quantity of primarily allocated bits of the sub-band $k_i$, and $\text{npluse}[k_i]$ indicates a quantity of primary information units of the sub-band $k_i$.

$$\beta_i = \frac{Rk_1[k_i]}{Rk_1[k_1] + Rk_1[k_2] + \ldots + Rk_1[k_N]} \quad (3)$$

where $Rk_1[k_i]$ indicates a quantity of primarily allocated bits of the sub-band $k_i$.

After the surplus bit allocation proportion for each sub-band of the sub-bands for secondary bit allocation is determined, the surplus bits may be allocated to each sub-band of the sub-bands for secondary bit allocation according to the proportion. Specifically, a quantity of secondarily allocated bits of the sub-band $k_i$ is $Rk_2[k_i]=\beta_i$*bit_surplus, where bit_surplus is the total quantity of surplus bits.

It should be understood that the above mentioned allocation proportion determining method is merely a specific embodiment of the present disclosure and shall not be construed as a limitation on the protection scope of the present disclosure. The above mentioned allocation proportion determining manner may have correspondingly transformations. For example, when the sub-bands for secondary bit allocation include two sub-bands, when an allocation proportion β for one sub-band among the sub-bands for secondary bit allocation is determined in any one of the foregoing three manners, a bit allocation proportion for the other sub-band may be determined as 1−β. All these simple mathematical transformations should fall within the protection scope of the present disclosure.

It should be further understood that, although it is assumed that there are a total of N sub-bands $k_1, k_2, \ldots$, and $k_N$, the purpose is merely to make the description applicable to general cases, and N is not limited to being greater than or equal to 3 herein. In a case in which N is 2, the foregoing several secondary bit allocation proportions are also applicable.

Therefore, in this embodiment of the present disclosure, primary bit allocation is first performed for to-be-processed sub-bands of a current frame according to a total quantity of to-be-allocated bits, so as to obtain a quantity of primarily allocated bits of each sub-band; a primary information unit quantity determining operation is performed for a sub-band that has undergone the primary bit allocation, so as to obtain a quantity of information units corresponding to each sub-band of the to-be-processed sub-bands and a total quantity of surplus bits; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

For clearer understanding of the present disclosure, the following describes the present disclosure in detail with reference to FIG. 2 to FIG. 9.

Figure 2:
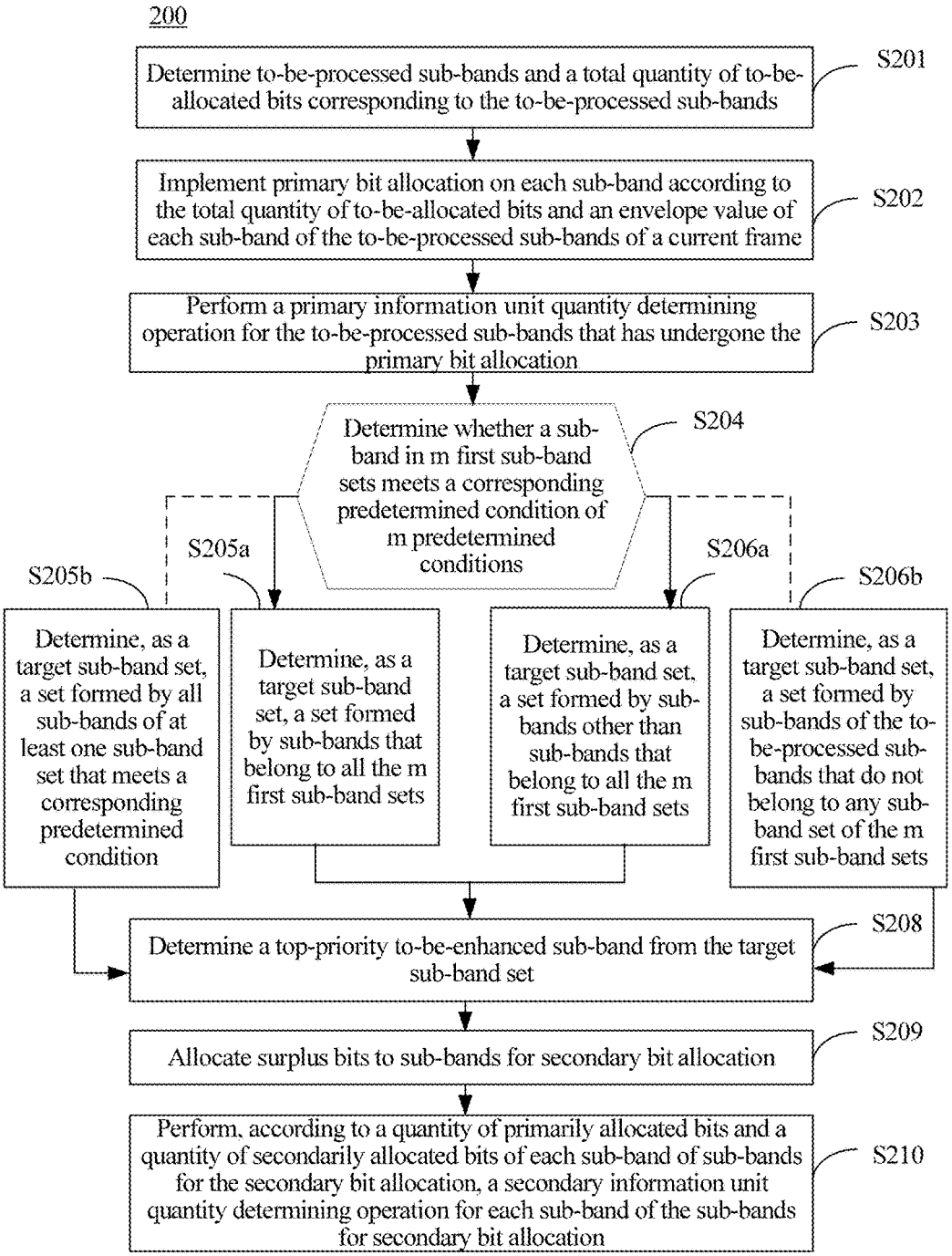
FIG. 2 is a schematic flowchart of a signal processing method according to another embodiment of the present disclosure.

FIG. 2 is a schematic flowchart of a signal processing method 200 according to an embodiment of the present disclosure. As shown in FIG. 2, the method 200 includes:

S201. Determine to-be-processed sub-bands of a current frame and a total quantity of to-be-allocated bits corresponding to the to-be-processed sub-bands.

S202. Implement primary bit allocation on each sub-band according to the total quantity of to-be-allocated bits and an envelope value of each sub-band of the to-be-processed sub-bands, so as to allocate the to-be-allocated bits to the to-be-processed sub-bands and obtain a quantity of primarily allocated bits of each sub-band.

S203. Perform a primary information unit quantity determining operation for the to-be-processed sub-bands that has undergone the primary bit allocation, so as to obtain a quantity of information units corresponding to each sub-band and a total quantity of surplus bits of the current frame.

S204. Determine whether a sub-band in the m first sub-band sets meets a corresponding predetermined condition of m predetermined conditions, where a sub-band of any one of the first sub-band sets belongs to the to-be-processed sub-bands. The following provides detailed description with reference to multiple examples.

Example 1: m is 1, the predetermined condition is that a sub-band carrying a signal of a harmonic type exists in first M high-frequency sub-bands, and a first sub-band set is the first M high-frequency sub-bands. Then, whether a sub-band carrying a signal of a harmonic type exists in the first M high-frequency sub-bands is determined.

Example 2: m is 1, the predetermined condition is that a coefficient-quantized sub-band exists in corresponding previous-frame sub-bands of first L high-frequency sub-bands, and a first sub-band set is the first L high-frequency sub-bands. Then, whether a coefficient-quantized sub-band exists in previous-frame sub-bands corresponding to the first L high-frequency sub-bands is determined.

Example 3: m is 1, and the predetermined condition is that an average envelope value of first J high-frequency sub-bands is greater than a threshold, where the average envelope value aver_Ep of the first J high-frequency sub-bands and the corresponding threshold θ may be calculated as follows:

$$\text{aver_Ep} = \frac{\sum_{i=BANDS-J}^{BANDS-1} Ep[i]}{J},$$

where Ep[i] indicates an envelope value of a sub-band i, and BANDS is a quantity of sub-bands; and $$\theta = \frac{1}{3} \cdot \frac{\sum_{i=0}^{BANDS-J-1} Ep[i]}{\text{BANDS} - J},$$

where Ep[i] indicates an envelope value of a sub-band i, and BANDS is a quantity of sub-bands.

In this case, whether the average envelope value aver_Ep of the first J high-frequency sub-bands is greater than the threshold θ needs to be determined.

Example 4: m is 2, a first sub-band set is first L high-frequency sub-bands, and a corresponding predetermined condition is that a coefficient-quantized sub-band exists in corresponding previous-frame sub-bands of the first L high-frequency sub-bands; another first sub-band set is the first J high-frequency sub-bands, and a corresponding predetermined condition is that an average envelope value of the first J high-frequency sub-bands is greater than a threshold. Then, whether a coefficient-quantized sub-band exists in the corresponding previous-frame sub-bands of the first L high-frequency sub-bands needs to be determined, and whether the average envelope value of the first J high-frequency sub-bands is greater than the threshold needs to be determined.

Example 5: m is 2, a first sub-band set is first L high-frequency sub-bands, and a corresponding predetermined condition is that a coefficient-quantized sub-band exists in corresponding previous-frame sub-bands of the first L high-frequency sub-bands; another first sub-band set is first M high-frequency sub-bands, and a corresponding predetermined condition is that a sub-band carrying a signal of a harmonic type exists in the first M high-frequency sub-bands. Then, whether a coefficient-quantized sub-band exists in the corresponding previous-frame sub-bands of the first L high-frequency sub-bands needs to be determined, and whether a sub-band carrying a signal of a harmonic type exists in the first M high-frequency sub-bands needs to be determined.

Example 6: m is 2, a first sub-band set is first J high-frequency sub-bands, and a corresponding predetermined condition is that an average envelope value of the first J high-frequency sub-bands is greater than a threshold; another first sub-band set is first M high-frequency sub-bands, and a corresponding predetermined condition is that a sub-band carrying a signal of a harmonic type exists in the first M high-frequency sub-bands. Then, whether the average envelope value of the first J high-frequency sub-bands is greater than the threshold needs to be determined, and whether a sub-band carrying a signal of a harmonic type exists in the first M high-frequency sub-bands needs to be determined.

Example 7: m is 3, a first sub-band set is first J high-frequency sub-bands, and a corresponding predetermined condition is that an average envelope value of the first J high-frequency sub-bands is greater than a threshold; another first sub-band set is first M high-frequency sub-bands, and a corresponding predetermined condition is that a sub-band carrying a signal of a harmonic type exists in the first M high-frequency sub-bands; and another first sub-band set is first L high-frequency sub-bands, and a corresponding predetermined condition is that a coefficient-quantized sub-band exists in corresponding previous-frame sub-bands of the first L high-frequency sub-bands. Then, whether the average envelope value of the first J high-frequency sub-bands is greater than the threshold needs to be determined, whether a sub-band carrying a signal of a harmonic type exists in the first M high-frequency sub-bands needs to be determined, and whether a coefficient-quantized sub-band exists in the corresponding previous-frame sub-bands of the first L high-frequency sub-bands needs to be determined.

For how a target sub-band set is selected, the following two manners are available:

In a first manner, when all sub-band sets of the m first sub-band sets meet the corresponding predetermined conditions, a set formed by sub-bands that belong to all the m first sub-band sets is determined as the target sub-band set (that is, S205*a* is performed), or when a sub-band set of the m first sub-band sets does not meet a corresponding predetermined condition, a set formed by sub-bands other than sub-bands that belong to all the m first sub-band sets is determined as the target sub-band set (that is, S206*a* is performed). For example, in example 1, if a sub-band carrying a signal of a harmonic type exists in the first M high-frequency sub-bands, a set formed by the first M high-frequency sub-bands may be determined as the target sub-band set; or if no sub-band carrying a signal of a harmonic type exists in the first M high-frequency sub-bands, a set formed by sub-bands other than the first M high-frequency sub-bands is determined as the target sub-band set. For example, in example 4, when a coefficient-quantized sub-band exists in the corresponding previous-frame sub-bands of the first L high-frequency sub-bands, and the average envelope value of the first J high-frequency sub-bands is greater than the threshold, an intersection of the first L high-frequency sub-bands and the first J high-frequency sub-bands may be determined as the target sub-band set; or when no coefficient-quantized sub-band exists in the corresponding previous-frame sub-bands of the first L high-frequency sub-bands, or the average envelope value of the first J high-frequency sub-bands is not greater than the threshold, sub-bands outside the intersection are determined as the target sub-band set. For another example, in example 7, when the average envelope value of the first J high-frequency sub-bands is greater than the threshold, a coefficient-quantized sub-band exists in the corresponding previous-frame sub-bands of the first L high-frequency sub-bands, and a sub-band carrying a signal of a harmonic type exists in the first M high-frequency sub-bands, an intersection of the first J high-frequency sub-bands, the first M high-frequency sub-bands, and the first L high-frequency sub-bands may be determined as the target sub-band set; or when the average envelope value of the first J high-frequency sub-bands is not greater than the threshold, no coefficient-quantized sub-band exists in the corresponding previous-frame sub-bands of the first L high-frequency sub-bands, or no sub-band carrying a signal of a harmonic type exists in the first M high-frequency sub-bands, sub-bands of the to-be-processed sub-bands outside the intersection are determined as the target sub-band set.

In a second manner, when at least one sub-band set of the m first sub-band sets meets a corresponding predetermined condition, a set formed by all sub-bands in the at least one sub-band set is determined as the target sub-band set (that is, S205*b* is performed), or when no sub-band set of the m first sub-band sets meets a corresponding predetermined condition, a set formed by sub-bands of the to-be-processed sub-bands that do not belong to any first sub-band set of the m first sub-band sets is determined as the target sub-band set (that is, S206*b* is performed). For example, in example 1, if a sub-band carrying a signal of a harmonic type exists in the first M high-frequency sub-bands, a set formed by the first M high-frequency sub-bands may be determined as the target sub-band set; or if no sub-band carrying a signal of a harmonic type exists in the first M high-frequency sub-bands, a set formed by sub-bands other than the first M high-frequency sub-bands is determined as the target sub-band set. For example, in example 4, when a coefficient-quantized sub-band exists in the corresponding previous-frame sub-bands of the first L high-frequency sub-bands, and the average envelope value of the first J high-frequency sub-bands is greater than the threshold, a set formed by first S (S=max(J, L)) sub-bands may be determined as the target sub-band set; or when no coefficient-quantized sub-band exists in the corresponding previous-frame sub-bands of the first L high-frequency sub-bands, or the average envelope value of the first J high-frequency sub-bands is not greater than the threshold, a set formed by sub-bands other than the first S sub-bands is determined as the target sub-band set. For another example, in example 7, when the average envelope value of the first J high-frequency sub-bands is greater than the threshold, a coefficient-quantized sub-band exists in the corresponding previous-frame sub-bands of the first L high-frequency sub-bands, and a sub-band carrying a signal of a harmonic type exists in the first M high-frequency sub-bands, a set formed by first S (S=max(J, L, M)) sub-bands may be determined as the target sub-band set; or when the average envelope value of the first J high-frequency sub-bands is not greater than the threshold, no coefficient-quantized sub-band exists in the corresponding previous-frame sub-bands of the first L high-frequency sub-bands, or no sub-band carrying a signal of a harmonic type exists in the first M high-frequency sub-bands, a set formed by sub-bands other than the first S sub-bands is determined as the target sub-band set. For another example, in example 7, when the average envelope value of the first J high-frequency sub-bands is not greater than the threshold, a coefficient-quantized sub-band exists in the corresponding previous-frame sub-bands of the first L high-frequency sub-bands, and a sub-band carrying a signal of a harmonic type exists in the first M high-frequency sub-bands, a set formed by first S (S=max(L, M)) sub-bands may be determined as the target sub-band set; or when the average envelope value of the first J high-frequency sub-bands is greater than the threshold, no coefficient-quantized sub-band exists in the corresponding previous-frame sub-bands of the first L high-frequency sub-bands, or no sub-band carrying a signal of a harmonic type exists in the first M high-frequency sub-bands, a set formed by sub-bands other than the first S sub-bands is determined as the target sub-band set.

S205*a*. Determine, as a target sub-band set, a set formed by sub-bands that belong to all the m first sub-band sets.

S206*a*. Determine, as a target sub-band set, a set formed by sub-bands of the to-be-processed sub-bands other than sub-bands that belong to all the m first sub-band sets.

S205*b*. Determine, as a target sub-band set, a set formed by all sub-bands of at least one sub-band set that meets a corresponding predetermined condition.

S206*b*. Determine, as a target sub-band set, a set formed by sub-bands of the to-be-processed sub-bands that do not belong to any sub-band set of the m first sub-band sets.

S207. Determine a top-priority to-be-enhanced sub-band k from the target sub-band set.

Specifically, a sub-band with a smallest average quantity of primary bits per unit bandwidth, a sub-band with a smallest quantity of bits per information unit, or a sub-band with a smallest quantity of primarily allocated bits in the target sub-band set may be determined as the top-priority to-be-enhanced sub-band k, where the smallest quantity of bits per information unit and the smallest quantity of primarily allocated bits are obtained from the primary information unit quantity determining operation.

S208. Determine a quantity N of sub-bands for secondary bit allocation and the sub-bands for secondary bit allocation. The quantity N of the sub-bands for secondary bit allocation and the sub-bands for secondary bit allocation may be determined in the following manners:

Manner 1:

Step 1: Determine a threshold alpha according to bandwidth of the top-priority to-be-enhanced sub-band, where the bandwidth of the top-priority to-be-enhanced sub-band may be in a positive correlation with the threshold alpha.

Figure 3:
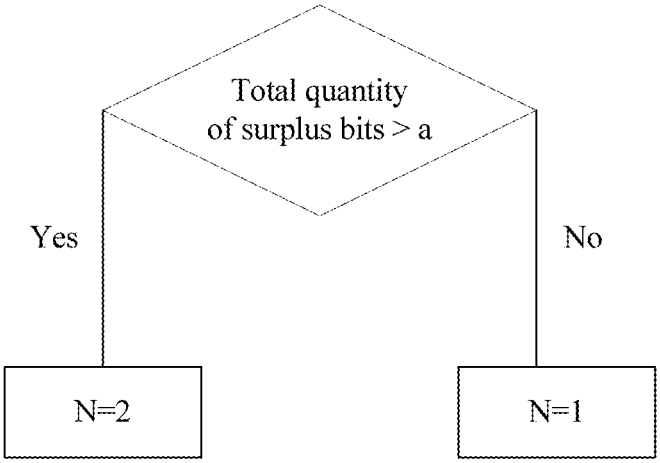
FIG. 3 is a schematic diagram of selecting sub-bands for secondary bit allocation according to another embodiment of the present disclosure.

Step 2: Determine whether the total quantity of the surplus bits (bit_surplus) is greater than the threshold alpha (a shown in FIG. 3); if the total quantity of surplus bits is greater than the threshold alpha, determine the quantity N of the sub-bands for secondary bit allocation as 2; or if the total quantity of surplus bits is less than the threshold alpha, determine the quantity N of the sub-bands for secondary bit allocation as 1, for example, as shown in FIG. 3.

Figure 4:
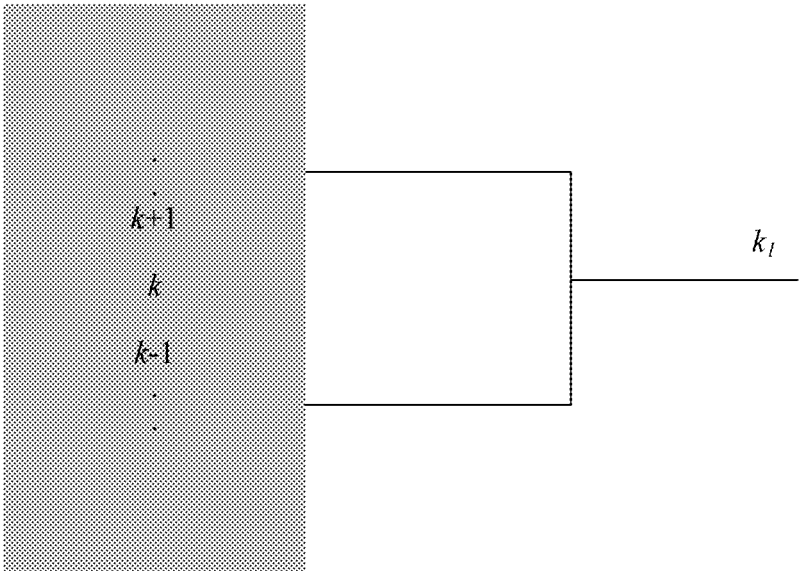
FIG. 4 is a schematic diagram of selecting sub-bands for secondary bit allocation according to another embodiment of the present disclosure.

Step 3: If N is equal to 1, determine that the sub-bands for secondary bit allocation include only the foregoing top-priority to-be-enhanced sub-band k. If N is equal to 2, it is required to further determine another sub-band included in the sub-bands for secondary bit allocation in addition to the top-priority to-be-enhanced sub-band k. To maintain continuity of a spectrum, one sub-band of two sub-bands k+1 and k−1 adjacent to the top-priority to-be-enhanced sub-band k may be determined as a second-priority to-be-enhanced sub-band $k_1$ (for example, as shown in FIG. 4), that is, the another sub-band included in the sub-bands for secondary bit allocation. Specifically, a sub-band with a smaller quantity of primarily allocated bits, a sub-band with a smaller average quantity of bits per unit bandwidth, or a sub-band with a smaller quantity of primary bits per information unit, of the two sub-bands k+1 and k−1 adjacent to the top-priority to-be-enhanced sub-band k may be determined as the second-priority to-be-enhanced sub-band $k_1$, that is, the another sub-band included in the sub-bands for secondary bit allocation.

Manner 2:

Step 1: Determine a second-priority to-be-enhanced sub-band $k_1$. One sub-band of two sub-bands k+1 and k−1 adjacent to the top-priority to-be-enhanced sub-band k may be determined as the second-priority to-be-enhanced sub-band $k_1$ (for example, as shown in FIG. 4). Specifically, a sub-band with a smaller quantity of primarily allocated bits, a sub-band with a smaller average quantity of primary bits per unit bandwidth, or a sub-band with a smaller quantity of bits per information unit, of the two sub-bands adjacent to the top-priority to-be-enhanced sub-band may be determined as the second-priority to-be-enhanced sub-band $k_1$, where the smaller quantity of bits per information unit is obtained from the primary information unit quantity determining operation.

Step 2: Determine a threshold alpha according to bandwidth of the top-priority to-be-enhanced sub-band k, where the bandwidth of the top-priority to-be-enhanced sub-band may be in a positive correlation with the threshold alpha.

Step 3: Determine whether the total quantity of surplus bits bit_surplus is greater than the threshold alpha; if the total quantity of surplus bits bit_surplus is greater than the threshold alpha, determine the quantity N of the sub-bands for secondary bit allocation as 2; or if the total quantity of surplus bits bit_surplus is less than the threshold alpha, determine the quantity N of the sub-bands for secondary bit allocation as 1, for example, as shown in FIG. 3.

Step 4: If N is equal to 1, determine that the sub-bands for secondary bit allocation include only the foregoing top-priority to-be-enhanced sub-band k; or if N is equal to 2, the sub-bands for secondary bit allocation further include the second-priority to-be-enhanced sub-band $k_1$ determined in step 1 in addition to the top-priority to-be-enhanced sub-band k.

Figure 5:
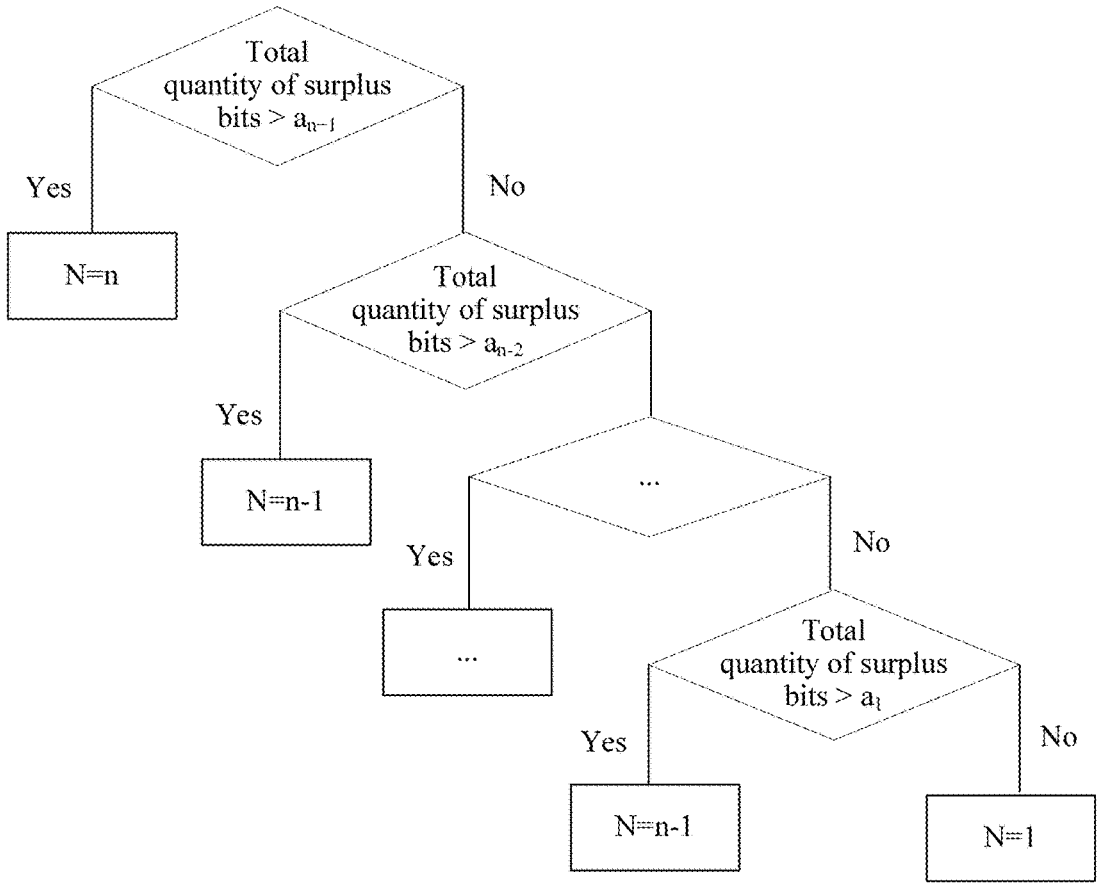
FIG. 5 is a schematic diagram of selecting sub-bands for secondary bit allocation according to another embodiment of the present disclosure.

Manner 3:

Step 1: Assume that there are n−1 thresholds ($alpha_{n-1}$, $alpha_{n-2}$, . . . , and $alpha_1$) sorted in ascending order. Whether the total quantity (bit_surplus) of the surplus bits is greater than the threshold $alpha_{n-1}$ may be first determined. If the total quantity (bit_surplus) of the surplus bits is greater than the threshold $alpha_{n-1}$, determine that the quantity of sub-bands for secondary bit allocation is N=n; or if the total quantity (bit_surplus) of the surplus bits is not greater than the threshold $alpha_{n-1}$, determine whether bit_surplus is greater than the threshold $alpha_{n-2}$, and if bit_surplus is greater than the threshold $alpha_{n-2}$, determine that N=n−1, and so on, for example, as shown in FIG. 5, where $a_n$ indicates $alpha_n$, $a_{n-1}$ indicates $alpha_{n-1}$, and $a_1$ indicates $alpha_1$.

Figure 6:
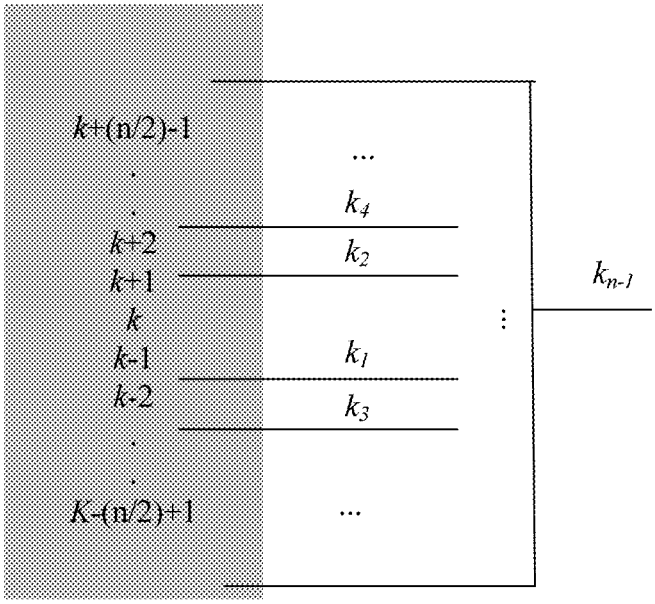
FIG. 6 is a schematic diagram of selecting sub-bands for secondary bit allocation according to another embodiment of the present disclosure.

Step 2: When N=1, determine that the sub-bands for secondary bit allocation include only the foregoing top-priority to-be-enhanced sub-band k; or when N>1, the sub-bands for secondary bit allocation further include another sub-band in addition to the top-priority to-be-enhanced sub-band k. To maintain continuity of a spectrum, if N=2, a sub-band with a smaller quantity of primarily allocated bits, a sub-band with a smaller average quantity of primary bits per unit bandwidth, or a sub-band with a smaller quantity of bits per information unit in previous-frame sub-bands k+2 and k−2 adjacent to sub-bands k+1 and k−1 may be determined as one sub-band for secondary bit allocation, where the smaller quantity of bits per information unit is obtained from the primary information unit quantity determining operation; if N=3, sub-bands k+1 and k−1 may be determined as the sub-bands for secondary bit allocation; if N=4, sub-bands k+1 and k−1 may be determined as the sub-bands for secondary bit allocation, and a sub-band is selected from sub-bands k+2 and k−2; or if N is greater than 4, another second-priority to-be-enhanced sub-band may be selected in a manner similar to the foregoing manner, for example, as shown in FIG. 6, second-priority to-be-enhanced sub-bands $k_1$, $K_2$, $k_3$, $k_4$, . . . , and $k_{n-1}$ are determined.

It should be understood that the foregoing manner 3 may also have another transformation, which should also fall within the protection scope of the present disclosure. For example, whether the total quantity of surplus bits bit_surplus is greater than the threshold $alpha_{n/2}$ may be first determined; if the total quantity of surplus bits bit_surplus is greater than the threshold $alpha_{n/2}$, determine whether the total quantity of surplus bits bit_surplus is less than $alpha_{(n/2)+1}$; and if the total quantity of surplus bits bit_surplus is less than $alpha_{(n/2)+1}$, determine whether the total quantity of surplus bits bit_surplus is greater than $alpha_{(n/2)-1}$, and so on.

S209. Allocate the surplus bits to the sub-bands for secondary bit allocation, so as to obtain a quantity of secondarily allocated bits of each sub-band of the sub-bands for secondary bit allocation. After the sub-bands for secondary bit allocation are determined, the surplus bits may be allocated to sub-bands included in the sub-bands for secondary bit allocation.

Specifically, when N=1, that is, the sub-bands for secondary bit allocation include only the top-priority to-be-enhanced sub-band, the surplus bits may all be allocated to the top-priority to-be-enhanced sub-band.

When N>1, the surplus bits may be allocated according to allocation proportions to sub-bands included in the sub-bands for secondary bit allocation, where a surplus bit allocation proportion for each sub-band may be determined according to a quantity of primary bits per information unit, an average quantity of primary bits per unit bandwidth, or a quantity of primarily allocated bits of the sub-band. For a specific determining method, reference may be made to the foregoing description.

S210. Perform, according to the quantity of primarily allocated bits and the quantity of secondarily allocated bits of each sub-band of the sub-bands for secondary bit allocation, a secondary information unit quantity determining operation for each sub-band of the sub-bands for secondary bit allocation.

Figure 7:
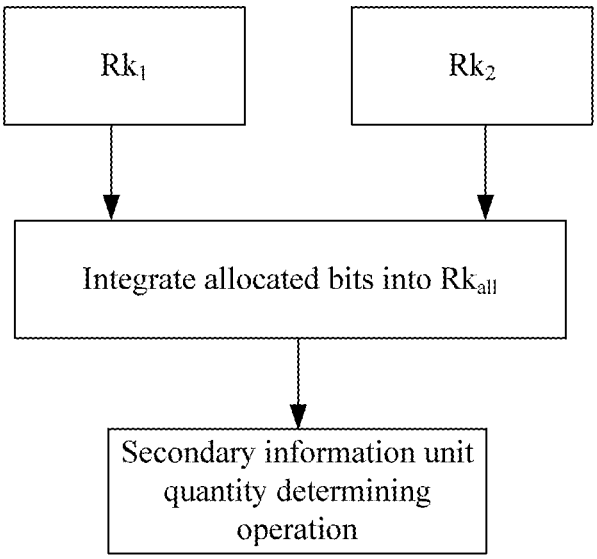
FIG. 7 is a schematic diagram of a secondary information unit quantity determining operation according to another embodiment of the present disclosure.

Specifically, as shown in FIG. 7, bits $Rk_1$ obtained in primary allocation and bits $Rk_2$ obtained in secondary allocation are integrated into $Rk_{all}$, and then the secondary information unit quantity determining operation is performed for the sub-bands for secondary bit allocation by using $Rk_{all}$.

Therefore, in this embodiment of the present disclosure, primary bit allocation is first performed for to-be-processed sub-bands according to a total quantity of to-be-allocated bits, so as to obtain a quantity of primarily allocated bits; a primary information unit quantity determining operation is performed for a sub-band that has undergone the primary bit allocation, so as to obtain a quantity of information units corresponding to each sub-band of the to-be-processed sub-bands and a total quantity of surplus bits; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

The signal processing methods in the embodiments of the present disclosure may be used on a decoder side and an encoder side.

When used on an encoder side, the method 100 may further include: performing a quantization operation for each sub-band according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and writing the quantized spectral coefficient into a bitstream and outputting the bitstream.

Optionally, in the case of use on the encoder side, when the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands, the method 100 may further include: writing the at least one parameter into the bitstream.

The embodiments of the present disclosure may also be applied to a decoder side. When used on a decoder side, the method 100 may further include:

performing an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and acquiring an output signal according to the inverse quantized spectral coefficient.

Optionally, in the case of use on the decoder side, when the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands, the method 100 may further include: acquiring the at least one parameter from a to-be-decoded bitstream.

Figure 8:
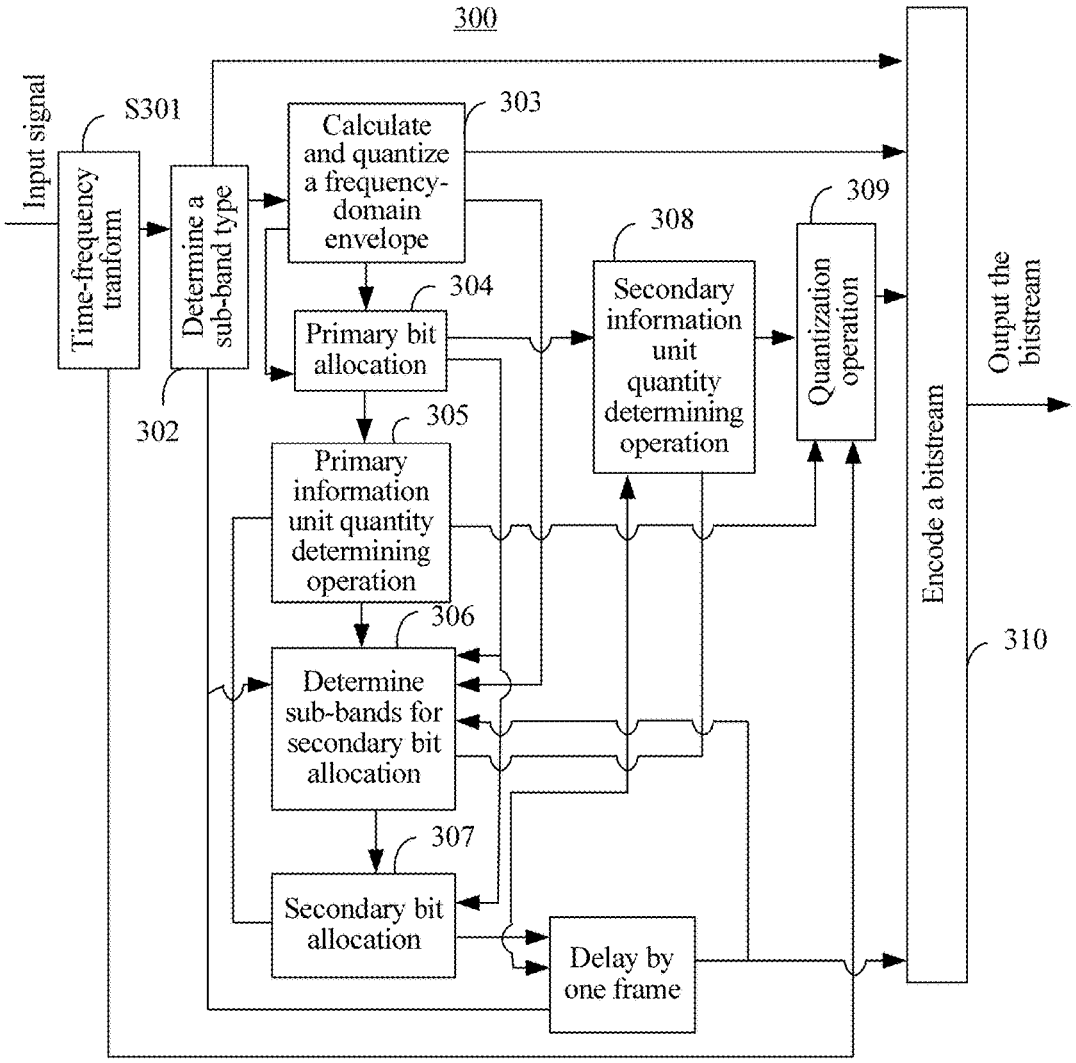
FIG. 8 is a schematic flowchart of a signal processing method according to another embodiment of the present disclosure.
Figure 9:
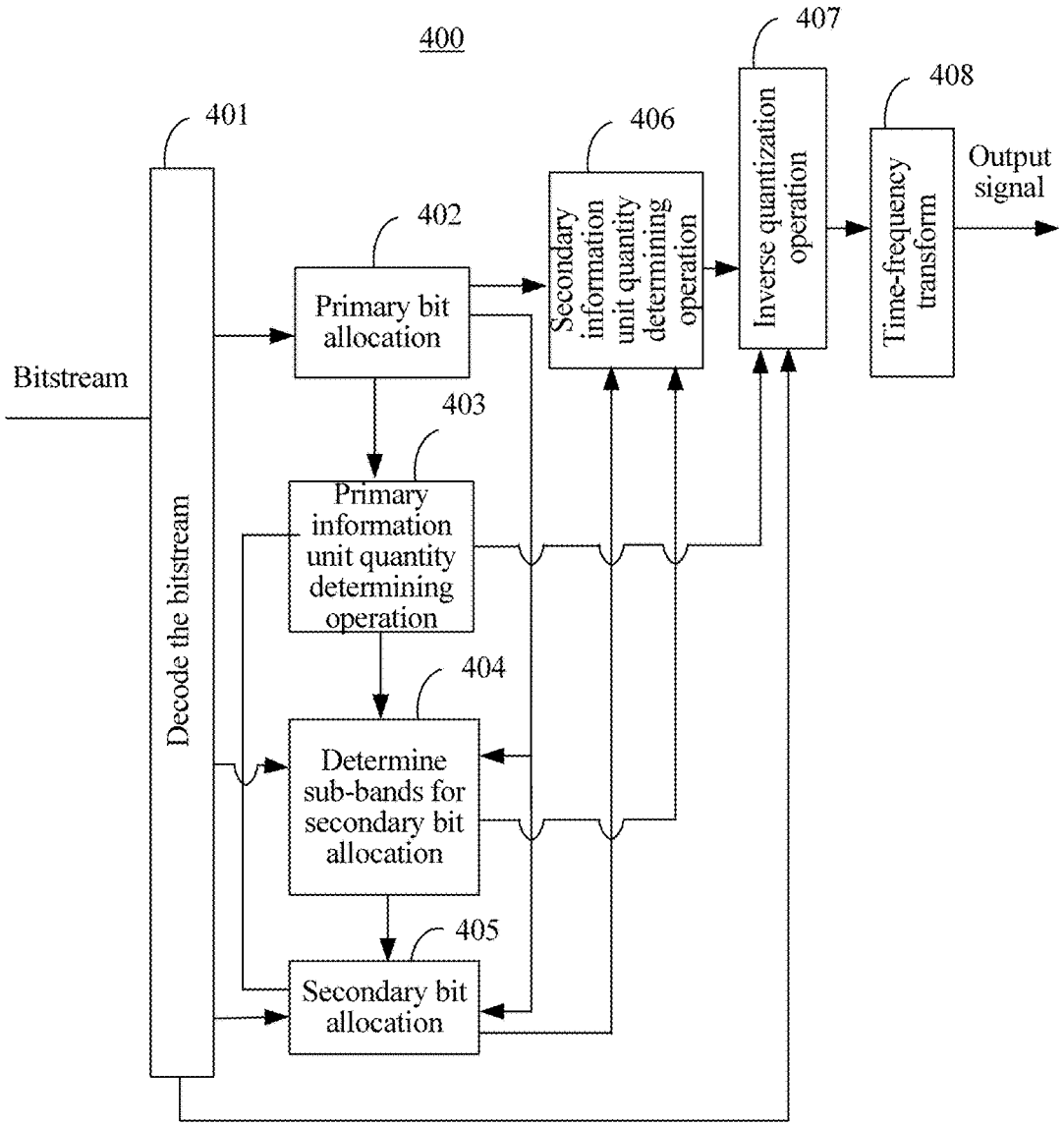
FIG. 9 is a schematic flowchart of a signal processing method according to another embodiment of the present disclosure.

For clearer understanding of the present disclosure, the following describes the signal processing method in the embodiments of the present disclosure with reference to FIG. 8 and FIG. 9, where FIG. 8 shows an encoding method, and FIG. 9 shows a decoding method.

FIG. 8 is a schematic diagram of an encoding method according to an embodiment of the present disclosure. As shown in FIG. 8, the method 300 may include:

S301. After acquiring an input signal (for example, an audio signal), an encoder side may perform a time-frequency transform on the input signal to obtain a frequency-domain signal, where sub-bands occupied by the frequency-domain signal are referred to as to-be-encoded sub-bands below.

S302. Determine a sub-band type of each sub-band of the to-be-encoded sub-bands, where the sub-band type of each sub-band may be a type of a signal carried in each sub-band, for example, the type of the signal may be harmonic or non-harmonic.

S303. Calculate and quantize a frequency-domain envelope according to the sub-band type of each sub-band that is determined in S302, so as to obtain an envelope value of each sub-band.

S304. Implement primary bit allocation on each sub-band according to the envelope value of each sub-band that is obtained in S303 and a total quantity of to-be-allocated bits, so as to obtain a quantity of primarily allocated bits of each sub-band.

S305. Perform a primary information unit quantity determining operation for each sub-band that has undergone the primary bit allocation, so that a quantity of information units corresponding to each sub-band and a total quantity of surplus bits may be obtained.

S306. Determine sub-bands for secondary bit allocation from the to-be-encoded sub-bands of a current frame according to at least one of the sub-band type of each sub-band of the current frame that is determined in S302, the envelope value of each sub-band of the current frame that is determined in S303, the quantity of primarily allocated bits of each sub-band of the current frame that is determined in S304, or the total quantity of surplus bits that is determined in S305. Optionally, sub-bands for secondary bit allocation may also be determined according to a bit allocation state of a corresponding previous-frame sub-band of each sub-band.

S307. Allocate the surplus bits to the sub-bands for secondary bit allocation according to the sub-bands for secondary bit allocation determined in S306 and the total quantity of surplus bits that is determined in S305. For specific allocation, secondary bit allocation may be performed according to the quantity of primarily allocated bits of each sub-band that has undergone the primary bit allocation in S304, and/or the quantity of primary bits per information unit (and/or an average quantity of bits per unit bandwidth).

S308. Perform, according to the quantity of primarily allocated bits that is obtained when the primary bit allocation (S304) is performed for the sub-bands for secondary bit allocation and a quantity of secondarily allocated bits that is obtained when the secondary bit allocation (S307) is performed, a secondary information unit quantity determining operation for each sub-band of the sub-bands for secondary bit allocation, so as to re-obtain a quantity of information units corresponding to each sub-band of the sub-bands for secondary bit allocation.

S309. Perform, according to the quantity of information units corresponding to each sub-band of the to-be-encoded sub-bands, a quantization operation for a sub-band that carries the frequency-domain signal obtained from the time-frequency transform in S301, so as to obtain a quantized spectral coefficient corresponding to each sub-band, where the quantity of information units corresponding to each sub-band of the sub-bands for secondary bit allocation of the current frame is the quantity of information units that is obtained from the secondary information unit quantity determining operation, and a quantity of information units corresponding to another sub-band of the current frame is a quantity of information units that is obtained from the primary information unit quantity determining operation.

S310. Write the quantized spectral coefficient, the bit allocation state of a corresponding previous-frame sub-band of each sub-band, and the sub-band type and the envelope value of each sub-band into a bitstream, and output the bitstream, so that a decoder side acquires the bitstream and performs decoding. When the bit allocation state of a corresponding previous-frame sub-band of each sub-band is not used for determining the sub-bands for secondary bit allocation in S306, the bit allocation state of a corresponding previous-frame sub-band of each sub-band may alternatively not be transferred to the decoder side.

FIG. 9 is a schematic flowchart of a decoding method 400 according to an embodiment of the present disclosure. As shown in FIG. 9, the method 400 may include:

S401. After acquiring a to-be-decoded bitstream, a decoder side may decode the to-be-decoded bitstream to obtain a quantized spectral coefficient of each sub-band of to-be-decoded sub-bands, a bit allocation state of a corresponding previous-frame sub-band of each sub-band, and a sub-band type and an envelope value of each sub-band.

S402. Implement primary bit allocation on each sub-band according to the envelope value of each sub-band of the to-be-decoded sub-bands that is acquired in S401 and a total quantity of to-be-allocated bits, so as to obtain a quantity of primarily allocated bits of each sub-band.

S403. Perform a primary information unit quantity determining operation for each sub-band that has undergone the primary bit allocation, so that a quantity of information units corresponding to each sub-band and a total quantity of surplus bits may be obtained.

S404. Determine sub-bands for secondary bit allocation from the to-be-decoded sub-bands according to at least one of the sub-band type of each sub-band, the envelope value of each sub-band, or the bit allocation state of a corresponding previous-frame sub-band of each sub-band that is acquired in S401, or the total quantity of surplus bits that is determined in S403 (a specific parameter that is used for determining the sub-bands for secondary bit allocation may be kept consistent with that on an encoder side).

S405. Allocate the surplus bits to the sub-bands for secondary bit allocation according to the sub-bands for secondary bit allocation determined in S404 and the total quantity of surplus bits that is determined in S403, so as to obtain a quantity of secondarily allocated bits of each sub-band of the sub-bands for secondary bit allocation. For specific allocation, secondary bit allocation may be performed according to the quantity of the primarily allocated bits of each sub-band that has undergone the primary bit allocation in S402, and/or a quantity of bits per information unit (and/or an average quantity of bits per unit bandwidth) after the primary information unit quantity determining operation in S403.

S406. Perform, according to the quantity of primarily allocated bits that is obtained when the primary bit allocation (S402) is performed for the sub-bands for secondary bit allocation and the quantity of secondarily allocated bits that is obtained when the secondary bit allocation (S405) is performed, a secondary information unit quantity determining operation for each sub-band of the sub-bands for secondary bit allocation, so as to re-obtain a quantity of information units corresponding to each sub-band of the sub-bands for secondary bit allocation.

S407. Perform, according to the quantity of information units corresponding to each sub-band of the to-be-decoded sub-bands, an inverse quantization operation for each sub-band obtained after the bitstream is decoded in S401, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation.

S408. Perform a time-frequency transform on the inverse quantized spectral coefficient corresponding to each sub-band, so as to obtain an output signal (for example, an audio signal).

Therefore, in this embodiment of the present disclosure, primary bit allocation is first performed for to-be-processed sub-bands according to a total quantity of to-be-allocated bits, so as to obtain a quantity of primarily allocated bits; a primary information unit quantity determining operation is performed for a sub-band that has undergone the primary bit allocation, so as to obtain a quantity of information units corresponding to each sub-band of the to-be-processed sub-bands and a total quantity of surplus bits; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

The foregoing has described the method in the embodiments of the present disclosure with reference to FIG. 1 to FIG. 9, and the following describes a signal processing apparatus in the embodiments of the present disclosure with reference to FIG. 10 to FIG. 13.

Figure 10:
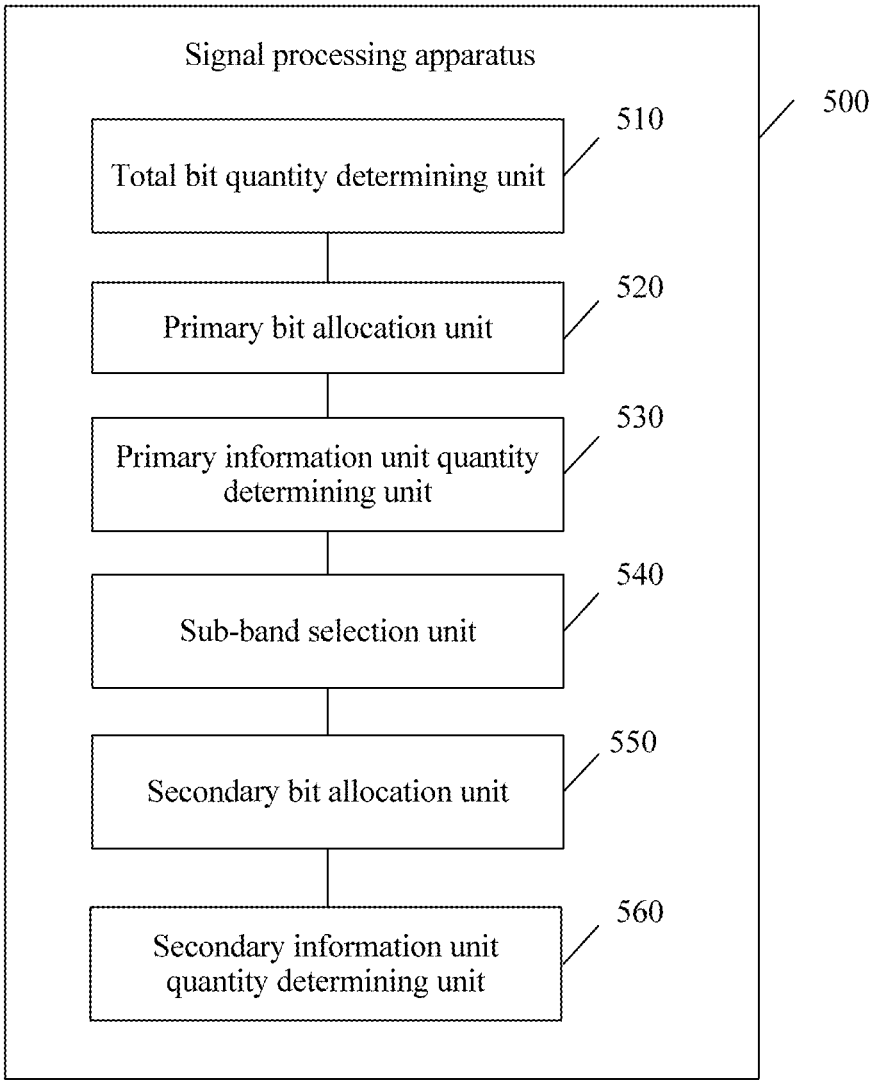
FIG. 10 is a schematic block diagram of a signal processing apparatus according to another embodiment of the present disclosure.

FIG. 10 is a schematic block diagram of a signal processing apparatus 500 according to an embodiment of the present disclosure. As shown in FIG. 10, the apparatus 500 includes:

a total bit quantity determining unit 510, configured to determine a total quantity of to-be-allocated bits corresponding to to-be-processed sub-bands of a current frame;

a primary bit allocation unit 520, configured to implement primary bit allocation on the to-be-processed sub-bands according to the total quantity of to-be-allocated bits, so as to obtain a quantity of primarily allocated bits of each sub-band of the to-be-processed sub-bands;

a primary information unit quantity determining unit 530, configured to perform, according to the quantity of primarily allocated bits of each sub-band, a primary information unit quantity determining operation for each sub-band that has undergone the primary bit allocation, so as to obtain a total quantity of surplus bits of the current frame and a quantity of information units corresponding to each sub-band of the to-be-processed sub-bands;

a sub-band selection unit 540, configured to select sub-bands for secondary bit allocation from the to-be-processed sub-bands according to a secondary bit allocation parameter, where the secondary bit allocation parameter includes at least one of a sub-band characteristic of each sub-band of the to-be-processed sub-bands or the total quantity of surplus bits;

a secondary bit allocation unit 550, configured to implement secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation; and a secondary information unit quantity determining unit 560, configured to perform, according to the quantities of primarily allocated bits and the quantities of secondarily allocated bits of the sub-bands for secondary bit allocation, a secondary information unit quantity determining operation for each sub-band of the sub-bands for secondary bit allocation, so as to re-obtain a quantity of information units corresponding to each sub-band of the sub-bands for secondary bit allocation.

Optionally, the sub-band characteristic of each sub-band of the to-be-processed sub-bands includes at least one of a characteristic of a signal carried in the sub-band, a bit allocation state corresponding to the sub-band, or a frequency range of the sub-band.

Optionally, the characteristic of the signal carried in the sub-band includes at least one of a type of the signal carried in the sub-band or an envelope value of the sub-band; and/or the bit allocation state corresponding to the sub-band includes at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band.

In this embodiment of the present disclosure, an average quantity of primary bits per unit bandwidth of any sub-band is determined according to a quantity of primarily allocated bits of the any sub-band and bandwidth of the any sub-band, and a quantity of primary bits per information unit of the any sub-band is determined according to the quantity of primarily allocated bits of the any sub-band and a quantity of primary information units of the any sub-band, where the quantity of primary information units of the any sub-band is obtained from the primary information unit quantity determining operation is performed for the any sub-band.

Optionally, the type of the signal carried in the sub-band includes harmonic and/or non-harmonic.

Figure 11:
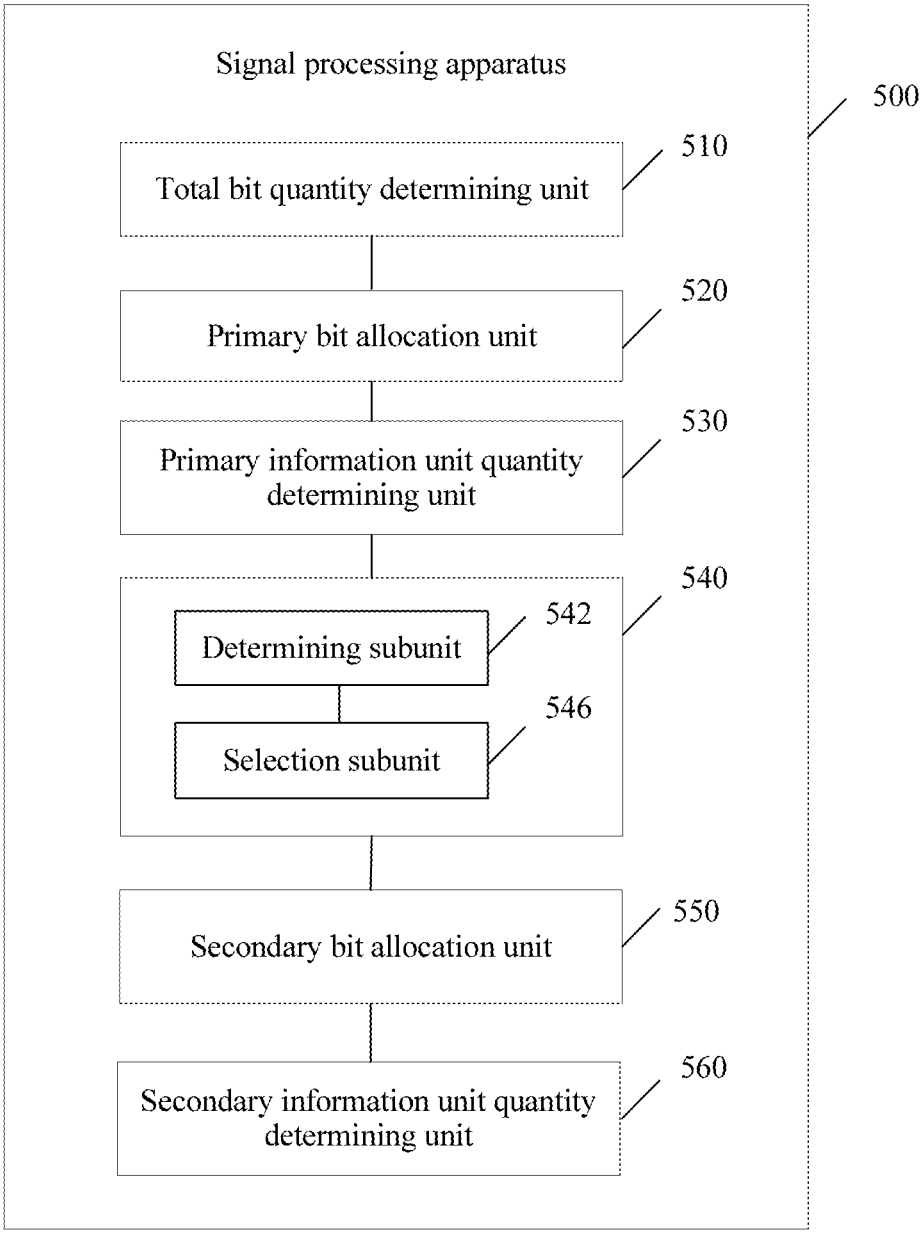
FIG. 11 is a schematic block diagram of a signal processing apparatus according to another embodiment of the present disclosure.

Optionally, as shown in FIG. 11, the sub-band selection unit 540 includes:

a determining subunit 542, configured to determine a target sub-band set according to at least one of the sub-band characteristic of each sub-band of the to-be-processed sub-bands or the total quantity of surplus bits; and a selection subunit 546, configured to select the sub-bands for secondary bit allocation from the target sub-band set, where a sub-band in the target sub-band set belongs to the to-be-processed sub-bands.

Optionally, the determining subunit 542 is specifically configured to:

determine the target sub-band set according to a sub-band characteristic of each sub-band in m first sub-band sets and m predetermined conditions in a one-to-one correspondence with the m first sub-band sets, where m is an integer greater than or equal to 1, and a sub-band in the m first sub-band sets belongs to the to-be-processed sub-bands, where when all sub-band sets of the m first sub-band sets meet the corresponding predetermined conditions, a set formed by sub-bands that belong to all the m first sub-band sets is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

Optionally, any predetermined condition of the m predetermined conditions includes at least one of the following conditions:

that a coefficient-quantized sub-band exists in corresponding previous-frame sub-bands in a corresponding first sub-band set, that an average envelope value of sub-bands in a corresponding first sub-band set is greater than a first threshold, or that a sub-band carrying a signal of a harmonic type exists in a corresponding first sub-band set.

Optionally, a frequency of a sub-band in the m first sub-band sets is higher than a frequency of a sub-band of the to-be-processed sub-bands other than the sub-bands in the m first sub-band sets.

Optionally, the selection subunit 546 is specifically configured to:

select the sub-bands for secondary bit allocation from the target sub-band set according to at least one of an average quantity of primary bits per unit bandwidth of each sub-band, a quantity of primary bits per information unit of each sub-band, or a quantity of primarily allocated bits of each sub-band in the target sub-band set.

Optionally, the selection subunit 546 is specifically configured to:

determine a sub-band with a smallest average quantity of primary bits per unit bandwidth, a sub-band with a smallest quantity of primary bits per information unit, or a sub-band with a smallest quantity of primarily allocated bits in the target sub-band set as a top-priority to-be-enhanced sub-band, where the top-priority to-be-enhanced sub-band belongs to the sub-bands for secondary bit allocation.

Optionally, the selection subunit 546 is specifically configured to:

when the total quantity of surplus bits is greater than a threshold $a_N$ and less than $a_{N+1}$, determine that N sub-bands for secondary bit allocation need to be selected, where $a_N$ and $a_{N+1}$ are respectively the $N^{th}$ threshold and the $(N+1)^{th}$ threshold of multiple thresholds sorted in ascending order; and when N is greater than or equal to 2, select N−1 sub-bands for secondary bit allocation from sub-bands in the target sub-band set other than the top-priority to-be-enhanced sub-band.

Optionally, the selection subunit 546 is specifically configured to:

determine the N−1 sub-bands for secondary bit allocation based on the top-priority to-be-enhanced sub-band for allocation, where the N sub-bands for secondary bit allocation are successive in a frequency domain.

Optionally, the selection subunit 546 is specifically configured to:

when the total quantity of surplus bits is greater than a threshold, determine a second-priority to-be-enhanced sub-band from the target sub-band set, where the sub-bands for secondary bit allocation include the second-priority to-be-enhanced sub-band and the top-priority to-be-enhanced sub-band.

Optionally, the selection subunit 546 is specifically configured to:

determine a second-priority to-be-enhanced sub-band from the target sub-band set; and when the total quantity of surplus bits is greater than a threshold, determine that the second-priority to-be-enhanced sub-band belongs to the sub-bands for secondary bit allocation.

Optionally, the selection subunit 546 is specifically configured to:

determine a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band as the second-priority to-be-enhanced sub-band.

Optionally, the secondary bit allocation unit 550 is specifically configured to:

when a quantity of sub-bands included in the sub-bands for secondary bit allocation is greater than or equal to 2, implement secondary bit allocation on the sub-bands for secondary bit allocation according to a quantity of primary bits per information unit, an average quantity of primary bits per unit bandwidth, or a quantity of primarily allocated bits, of each sub-band of the sub-bands for secondary bit allocation.

Optionally, the primary bit allocation unit 520 is specifically configured to:

implement primary bit allocation on the to-be-processed sub-bands according to the total quantity of to-be-allocated bits and envelope values of sub-bands of the to-be-processed sub-bands.

The signaling processing apparatus 500 in this embodiment of the present disclosure may be used to implement the signaling processing methods in the method embodiments. For brevity, details are not described herein.

Therefore, in this embodiment of the present disclosure, primary bit allocation is first performed for to-be-processed sub-bands according to a total quantity of to-be-allocated bits of a current frame, so as to obtain a quantity of primarily allocated bits; a primary information unit quantity determining operation is performed for a sub-band that has undergone the primary bit allocation, so as to obtain a quantity of information units corresponding to each sub-band of the to-be-processed sub-bands and a total quantity of surplus bits; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

Optionally, the signal processing apparatus in this embodiment of the present disclosure may be an encoder or may be a decoder. The following provides detailed description with reference to FIG. 12 and FIG. 13.

Figure 12:
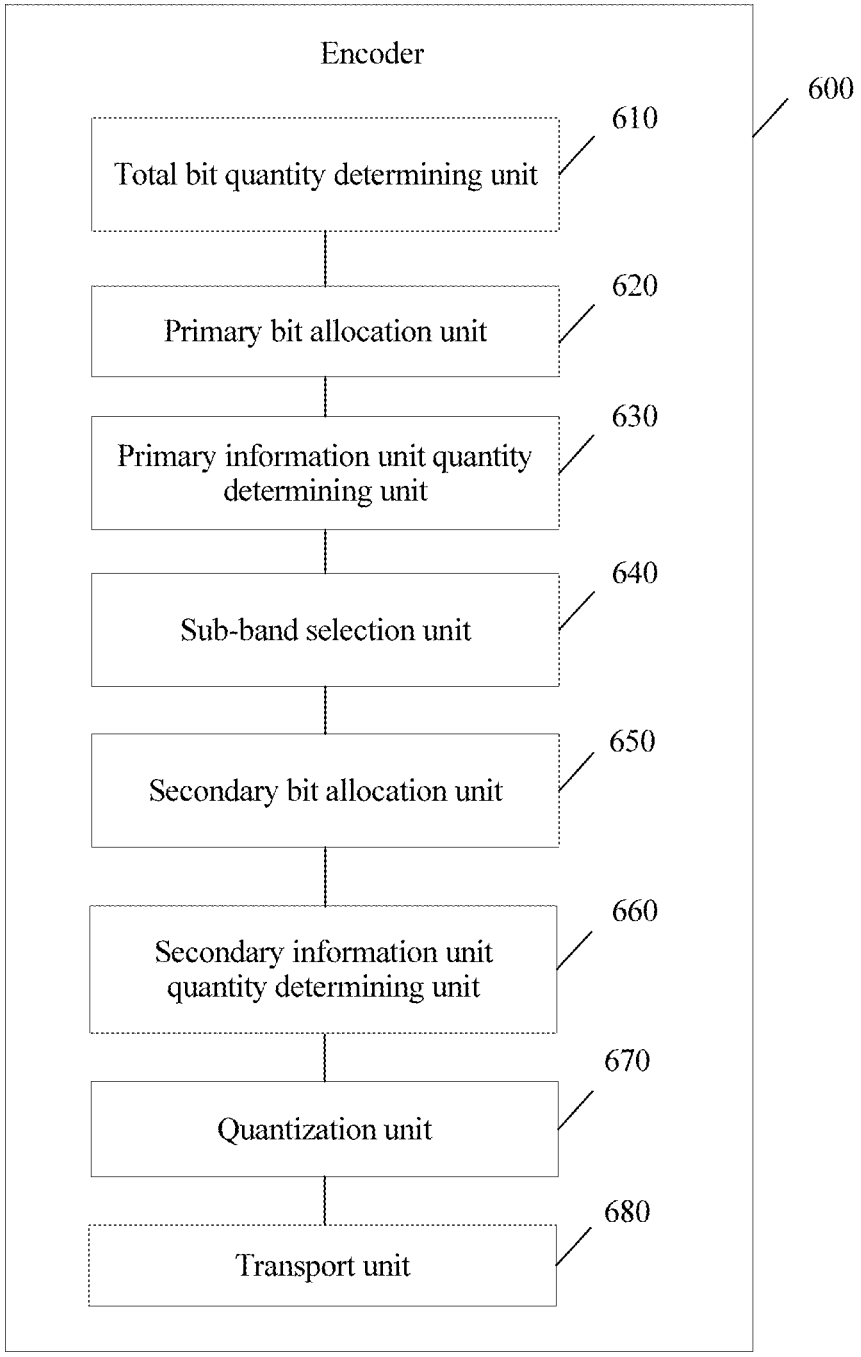
FIG. 12 is a schematic block diagram of a signal processing apparatus according to another embodiment of the present disclosure.

FIG. 12 is a schematic block diagram of a signal processing apparatus 600 according to an embodiment of the present disclosure. A quantization unit 670 and a transport unit 680 may be further included in addition to a total bit quantity determining unit 610, a primary bit allocation unit 620, a primary information unit quantity determining unit 630, a sub-band selection unit 640, a secondary bit allocation unit 650, and a secondary information unit quantity determining unit 660.

The quantization unit 670 is configured to perform a quantization operation for each sub-band of the to-be-processed sub-bands according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation.

The transport unit 680 is configured to write the quantized spectral coefficient into a bitstream and output the bitstream.

Optionally, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands.

The transport unit 680 is further configured to: write the at least one parameter into the bitstream.

It should be understood that the total bit quantity determining unit 610, the primary bit allocation unit 620, the primary information unit quantity determining unit 630, the sub-band selection unit 640, the secondary bit allocation unit 650, and the secondary information unit quantity determining unit 660 of the encoder 600 may be respectively equivalent to the total bit quantity determining unit 510, the primary bit allocation unit 520, the primary information unit quantity determining unit 530, the sub-band selection unit 540, the secondary bit allocation unit 550, and the secondary information unit quantity determining unit 560 of the signal processing apparatus 500. For brevity, details are not described herein. It should be further understood that the encoder 600 may further implement a corresponding procedure of the encoding method 300. For brevity, details are not described herein.

Figure 13:
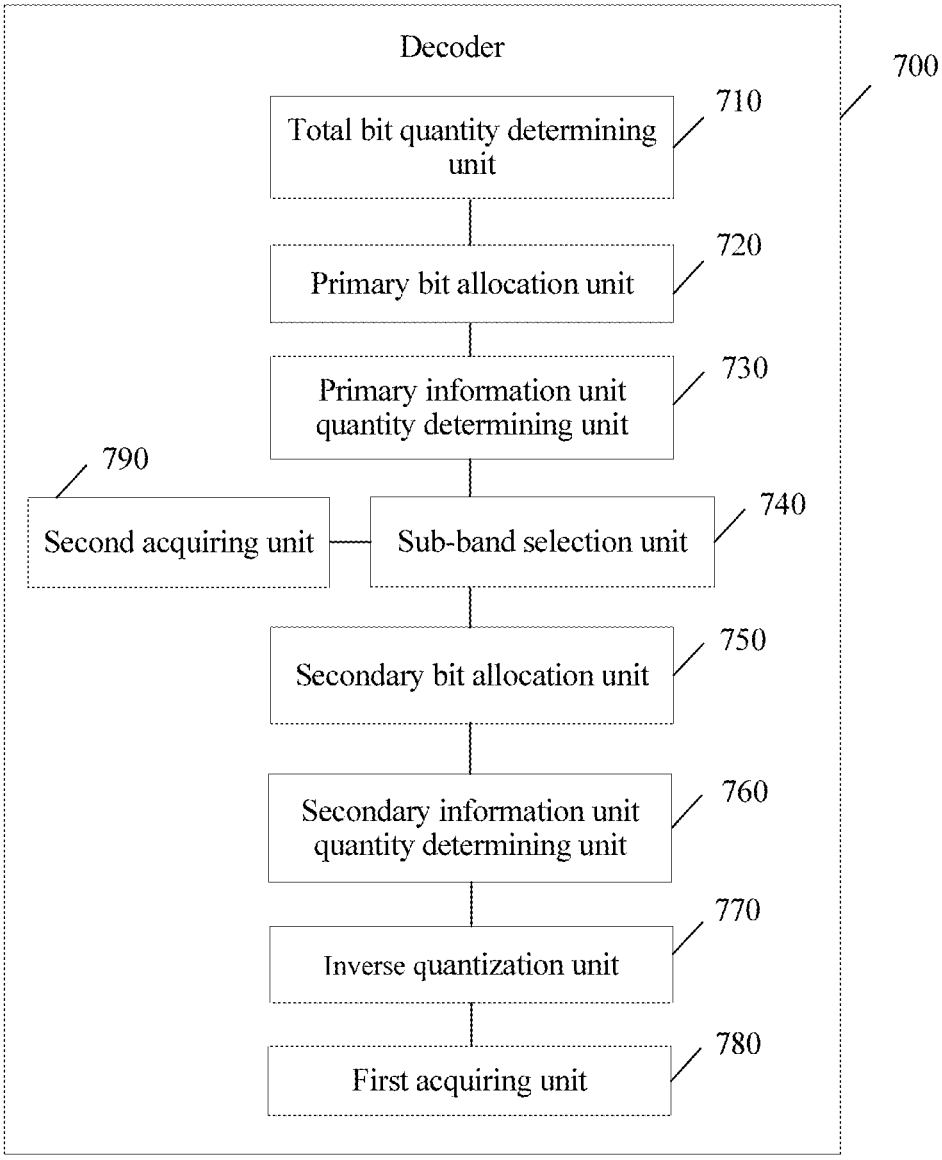
FIG. 13 is a schematic block diagram of a signal processing apparatus according to another embodiment of the present disclosure.

FIG. 13 is a schematic block diagram of a signal processing apparatus 700 according to an embodiment of the present disclosure. An inverse quantization unit 770 and a first acquiring unit 780 may be further included in addition to a total bit quantity determining unit 710, a primary bit allocation unit 720, a primary information unit quantity determining unit 730, a sub-band selection unit 740, a secondary bit allocation unit 750, and a secondary information unit quantity determining unit 760.

The inverse quantization unit 770 is configured to perform an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation.

The first acquiring unit 780 is configured to acquire an output signal according to the inverse quantized spectral coefficient.

Optionally, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands. The decoder 700 further includes:

a second acquiring unit 790, configured to acquire the at least one parameter from a to-be-decoded bitstream.

It should be understood that the total bit quantity determining unit 710, the primary bit allocation unit 720, the primary information unit quantity determining unit 730, the sub-band selection unit 740, the secondary bit allocation unit 750, and the secondary information unit quantity determining unit 760 of the signal processing apparatus 700 may be respectively equivalent to the total bit quantity determining unit 510, the primary bit allocation unit 520, the primary information unit quantity determining unit 530, the sub-band selection unit 540, the secondary bit allocation unit 550, and the secondary information unit quantity determining unit 560 of the signal processing apparatus 500. For brevity, details are not described herein. It should be further understood that the decoder 700 may further implement a corresponding procedure of the decoding method 400. For brevity, details are not described herein.

Figure 14:
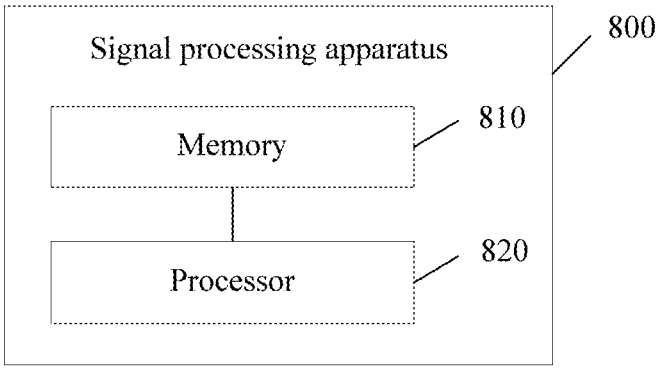
FIG. 14 is a schematic block diagram of a signal processing apparatus according to another embodiment of the present disclosure.

FIG. 14 is a schematic block diagram of a signal processing apparatus 800 according to an embodiment of the present disclosure. According to the apparatus 800 shown in FIG. 14, the apparatus 800 includes a memory 810 and a processor 820. The memory 810 is configured to store program code, and the processor 820 is configured to call the program code stored in the memory 810 to perform the following operations:

determining a total quantity of to-be-allocated bits corresponding to to-be-processed sub-bands of a current frame;

implementing primary bit allocation on the to-be-processed sub-bands according to the total quantity of to-be-allocated bits, so as to obtain a quantity of primarily allocated bits of each sub-band of the to-be-processed sub-bands;

performing, according to the quantity of primarily allocated bits of each sub-band, a primary information unit quantity determining operation for each sub-band that has undergone the primary bit allocation, so as to obtain a quantity of information units corresponding to each sub-band of the to-be-processed sub-bands and a total quantity of surplus bits of the current frame;

selecting sub-bands for secondary bit allocation from the to-be-processed sub-bands according to a secondary bit allocation parameter, where the secondary bit allocation parameter includes at least one of a sub-band characteristic of each sub-band of the to-be-processed sub-bands or the total quantity of surplus bits;

implementing secondary bit allocation on the sub-bands for secondary bit allocation, so as to allocate the surplus bits to the sub-bands for secondary bit allocation and obtain a quantity of secondarily allocated bits of each sub-band of the sub-bands for secondary bit allocation; and performing, according to the quantities of primarily allocated bits and the quantities of secondarily allocated bits of the sub-bands for secondary bit allocation, a secondary information unit quantity determining operation for each sub-band of the sub-bands for secondary bit allocation, so as to re-obtain a quantity of information units corresponding to each sub-band of the sub-bands for secondary bit allocation.

Optionally, the sub-band characteristic of each sub-band of the to-be-processed sub-bands includes at least one of a characteristic of a signal carried in the sub-band, a bit allocation state corresponding to the sub-band, or a frequency range of the sub-band.

Optionally, the characteristic of the signal carried in the sub-band includes at least one of a type of the signal carried in the sub-band or an envelope value of the sub-band; and/or the bit allocation state corresponding to the sub-band includes at least one of a coefficient quantization state of a corresponding previous-frame sub-band of the sub-band, a quantity of primary bits per information unit of the sub-band, an average quantity of primary bits per unit bandwidth of the sub-band, or a quantity of primarily allocated bits of the sub-band.

Optionally, the type of the signal carried in the sub-band includes harmonic and/or non-harmonic.

Optionally, the processor 820 is configured to call the program code stored in the memory 810 to specifically perform the following operations:

determining a target sub-band set according to at least one of the sub-band characteristic of each sub-band of the to-be-processed sub-bands or the total quantity of surplus bits, and selecting the sub-bands for secondary bit allocation from the target sub-band set, where a sub-band in the target sub-band set belongs to the to-be-processed sub-bands.

Optionally, the processor 820 is configured to call the program code stored in the memory 810 to specifically perform the following operation:

determining the target sub-band set according to a sub-band characteristic of each sub-band in m first sub-band sets and m predetermined conditions in a one-to-one correspondence with the m first sub-band sets, where m is an integer greater than or equal to 1, and a sub-band in the m first sub-band sets belongs to the to-be-processed sub-bands, where when all sub-band sets of the m first sub-band sets meet the corresponding predetermined conditions, a set formed by sub-bands that belong to all the m first sub-band sets is determined as the target sub-band set, or when a sub-band set of the m first sub-band sets does not meet a corresponding predetermined condition, a set formed by sub-bands of the to-be-processed sub-bands other than sub-bands that belong to all the m first sub-band sets is determined as the target sub-band set; or when at least one sub-band set of the m first sub-band sets meets a corresponding predetermined condition, a set formed by all sub-bands in the at least one sub-band set is determined as the target sub-band set, or when no sub-band set of the m first sub-band sets meets a corresponding predetermined condition, a set formed by sub-bands of the to-be-processed sub-bands that do not belong to any sub-band set of the m first sub-band sets is determined as the target sub-band set.

Optionally, any predetermined condition of the m predetermined conditions includes at least one of the following conditions:

that a coefficient-quantized sub-band exists in corresponding previous-frame sub-bands of a corresponding first sub-band set, that an average envelope value of sub-bands in a corresponding first sub-band set is greater than a first threshold, or that a sub-band carrying a signal of a harmonic type exists in a corresponding first sub-band set.

Optionally, a frequency of a sub-band in the m first sub-band sets is higher than a frequency of a sub-band of the to-be-processed sub-bands other than the sub-bands in the m first sub-band sets.

Optionally, the processor 820 is configured to call the program code stored in the memory 810 to specifically perform the following operation:

selecting the sub-bands for secondary bit allocation from the target sub-band set according to at least one of an average quantity of primary bits per unit bandwidth of each sub-band, a quantity of primary bits per information unit of each sub-band, or a quantity of primarily allocated bits of each sub-band in the target sub-band set.

In this embodiment of the present disclosure, an average quantity of primary bits per unit bandwidth of any sub-band is determined according to a quantity of primarily allocated bits of the any sub-band and bandwidth of the any sub-band, and a quantity of primary bits per information unit of the any sub-band is determined according to the quantity of primarily allocated bits of the any sub-band and a quantity of primary information units of the any sub-band, where the quantity of primary information units of the any sub-band is obtained from the primary information unit quantity determining operation is performed for the any sub-band.

Optionally, the processor 820 is configured to call the program code stored in the memory 810 to specifically perform the following operation:

determining a sub-band with a smallest average quantity of bits per unit bandwidth, a sub-band with a smallest quantity of primary bits per information unit, or a sub-band with a smallest quantity of primarily allocated bits, obtained from the primary information unit quantity determining operation in the target sub-band set as a top-priority to-be-enhanced sub-band, where the top-priority to-be-enhanced sub-band belongs to the sub-bands for secondary bit allocation.

Optionally, the processor 820 is configured to call the program code stored in the memory 810 to specifically perform the following operations:

when the total quantity of surplus bits is greater than a threshold $a_N$ and less than $a_{N+1}$, determining that N sub-bands for secondary bit allocation need to be selected, where $a_N$ and $a_{N+1}$ are respectively the $N^{th}$ threshold and the $(N+1)^{th}$ threshold of multiple thresholds sorted in ascending order; and when N is greater than or equal to 2, selecting N−1 sub-bands for secondary bit allocation from sub-bands in the target sub-band set other than the top-priority to-be-enhanced sub-band.

Optionally, the processor 820 is configured to call the program code stored in the memory 810 to specifically perform the following operation:

determining the N−1 sub-bands for secondary bit allocation based on the top-priority to-be-enhanced sub-band for allocation, where the N sub-bands for secondary bit allocation are successive in a frequency domain.

Optionally, the processor 820 is configured to call the program code stored in the memory 810 to specifically perform the following operation:

when the total quantity of surplus bits is greater than a threshold, determining a second-priority to-be-enhanced sub-band from the target sub-band set, where the sub-bands for secondary bit allocation include the second-priority to-be-enhanced sub-band and the top-priority to-be-enhanced sub-band.

Optionally, the processor 820 is configured to call the program code stored in the memory 810 to specifically perform the following operations:

determining a second-priority to-be-enhanced sub-band from the target sub-band set; and when the total quantity of surplus bits is greater than a threshold, determining that the second-priority to-be-enhanced sub-band belongs to the sub-bands for secondary bit allocation.

Optionally, the processor 820 is configured to call the program code stored in the memory 810 to specifically perform the following operation:

determining a sub-band with a smaller average quantity of primary bits per unit bandwidth, a sub-band with a smaller quantity of primary bits per information unit, or a sub-band with a smaller quantity of primarily allocated bits, of two sub-bands adjacent to the top-priority to-be-enhanced sub-band as the second-priority to-be-enhanced sub-band.

Optionally, the processor 820 is configured to call the program code stored in the memory 810 to specifically perform the following operation:

when a quantity of sub-bands included in the sub-bands for secondary bit allocation is greater than or equal to 2, implementing secondary bit allocation on the sub-bands for secondary bit allocation according to a quantity of primary bits per information unit, an average quantity of primary bits per unit bandwidth, or a quantity of primarily allocated bits, of each sub-band of the sub-bands for secondary bit allocation.

Optionally, the processor 820 is configured to call the program code stored in the memory 810 to specifically perform the following operation:

implementing primary bit allocation on the to-be-processed sub-bands according to the total quantity of to-be-allocated bits and envelope values of sub-bands of the to-be-processed sub-bands.

Optionally, the apparatus 800 is an encoder, and the processor 820 is configured to call the program code stored in the memory 810 to further perform the following operations:

performing a quantization operation for each sub-band of the to-be-processed sub-bands according to the quantity of information units corresponding to each sub-band of the to-be-processed sub-bands, so as to obtain a quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and writing the quantized spectral coefficient into a bitstream and outputting the bitstream.

Optionally, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands. When the apparatus 800 is an encoder, the processor 820 is configured to call the program code stored in the memory 810 to further perform the following operation: writing the at least one parameter into the bitstream.

Optionally, the apparatus 800 is a decoder, and the processor 820 is configured to call the program code stored in the memory 810 to further perform the following operations:

performing an inverse quantization operation for each sub-band of the to-be-processed sub-bands according to the quantity of information units corresponding to each sub-band of the to-be-processed sub-bands, so as to obtain an inverse quantized spectral coefficient corresponding to each sub-band, where the quantity of information units corresponding to each sub-band of the sub-bands for secondary bit allocation is the quantity of information units that is obtained from the secondary information unit quantity determining operation, and a quantity of information units corresponding to another sub-band is a quantity of information units that is obtained from the primary information unit quantity determining operation; and acquiring an output signal according to the inverse quantized spectral coefficient.

Optionally, when the apparatus 800 is a decoder, the secondary bit allocation parameter includes at least one parameter of a type of a signal carried in at least one sub-band of the to-be-processed sub-bands, an envelope value of at least one sub-band of the to-be-processed sub-bands, or a coefficient quantization state of a corresponding previous-frame sub-band of at least one sub-band of the to-be-processed sub-bands. When the apparatus 800 is a decoder, the processor 820 is configured to call the program code stored in the memory 810 to further perform the following operation: acquiring the at least one parameter from a to-be-decoded bitstream.

The signaling processing apparatus 500 in this embodiment of the present disclosure may be used to implement the signaling processing methods in the method embodiments. For brevity, details are not described herein.

Therefore, in this embodiment of the present disclosure, primary bit allocation is first performed for to-be-processed sub-bands according to a total quantity of to-be-allocated bits of a current frame, so as to obtain a quantity of primarily allocated bits; a primary information unit quantity determining operation is performed for a sub-band that has undergone the primary bit allocation, so as to obtain a total quantity of surplus bits and a quantity of information units corresponding to each sub-band of the to-be-processed sub-bands; then, sub-bands for secondary bit allocation are determined according to at least one of a sub-band characteristic of each sub-band of the to-be-processed sub-bands or the total quantity of surplus bits, and the surplus bits are allocated to the sub-bands for secondary bit allocation to obtain a quantity of secondarily allocated bits of each sub-band of the sub-bands for secondary bit allocation; a secondary information unit quantity determining operation is performed for each sub-band of the sub-bands for secondary bit allocation according to the quantity of primarily allocated bits and the quantity of secondarily allocated bits of each sub-band of the sub-bands for secondary bit allocation, so as to re-obtain a quantity of information units corresponding to each sub-band of the sub-bands for secondary bit allocation. The surplus bits left in encoded sub-bands are not evenly allocated to remaining unencoded sub-bands, and therefore, available bits can be more properly and fully used and encoding and decoding quality is apparently improved.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present disclosure.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the prior art, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present disclosure. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An audio signal processing method, comprising:

allocating, according to a total number of available bits to be allocated, a quantity of primarily allocated bits for each of at least a portion of sub-bands of a frame of an audio signal, wherein a quantity of the portion of sub-bands is greater than two;

performing, according to the quantity of primarily allocated bits for each of the portion of the sub-bands, a pulse quantity determination operation for each of the portion of the sub-bands respectively, so as to obtain a quantity of surplus bits of the frame, wherein the surplus bits are a part of the available bits;

selecting, according to a secondary bit allocation parameter, two subbands for secondary bit allocation from the portion of the sub-bands, wherein the secondary bit allocation parameter comprises: an average quantity of primary bits per unit bandwidth of each sub-band of the portion of sub-bands, and a frequency range of each sub-band of the portion of sub-bands, wherein the average quantity of primary bits per unit bandwidth of the sub-band is determined according to the quantity of primarily allocated bits of the sub-band and bandwidth of the sub-band;

allocating, according to the quantity of the surplus bits, a quantity of secondarily allocated bits for each of the two sub-bands;

determining a quantity of pulses for each of the two sub-bands respectively according to the quantity of primarily allocated bits for each of the two sub-bands and the quantity of secondarily allocated bits for each of the two sub-bands; and quantizing spectral coefficients for each of the two sub-bands according to the determined quantity of pulses for each of the two sub-bands.

2. The method according to claim 1, wherein the secondary bit allocation parameter further comprises: a quantization state of a previous-frame sub-band corresponding to each sub-band of the portion of sub-band.

3. The method according to claim 1, wherein the secondary bit allocation parameter further comprises:

a signal type of the signal of each sub-band of the portion of sub-band.

4. The method according to claim 3, wherein the signal type of the signal of each sub-band of the portion of sub-band is either harmonic or non-harmonic.

5. The method according to claim 1, wherein the two sub-bands selected for secondary bit allocation are successive in a frequency domain.

6. The method according to claim 1, wherein the two sub-bands for secondary bit allocation are selected by:

determining a target sub-band set according to at least one of the quantity of surplus bits or the sub-band characteristic of the sub-band, wherein the two sub-bands are selected from the target sub-band set, wherein each sub-band in the target sub-band set belongs to the frame.

7. The method according to claim 6, wherein the target sub-band set is determined according to a sub-band characteristic of a sub-band in m first sub-band sets one-to-one correspondingly related to m predetermined conditions, wherein m is an integer greater than or equal to 1, and each sub-band in the m first sub-band sets belongs to the frame.

8. The method according to claim 7, wherein the target sub-band set corresponds to a set formed by sub-bands that belong to all the m first sub-band sets when all sub-band sets of the m first sub-band sets meet the corresponding predetermined conditions.

9. The method according to claim 7, wherein the target sub-band set corresponds to a set formed by remaining sub-bands of the frame other than sub-bands that belong to all the m first sub-band sets when a sub-band set of the m first sub-band sets does not meet a corresponding predetermined condition.

10. The method according to claim 7, wherein the target sub-band set corresponds to a set formed by all sub-bands in at least one sub-band set of the m first sub-band sets, each of the at least one sub-band set meeting a corresponding predetermined condition.

11. The method according to claim 7, wherein the target sub-band set corresponds to a set formed by sub-bands of the frame that do not belong to any sub-band set of the m first sub-band sets when no sub-band set of the m first sub-band sets meets a corresponding predetermined condition.

12. The method according to claim 7, wherein any predetermined condition of the m predetermined conditions comprises at least one of the following conditions:

that a coefficient-quantized sub-band exists in previous-frame sub-bands of a corresponding first sub-band set, that an average envelope value of sub-bands in the corresponding first sub-band set is greater than a first threshold, or that a sub-band carrying a signal of a harmonic type exists in the corresponding first sub-band set.

13. The method according to claim 7, wherein a frequency of a sub-band in the m first sub-band sets is higher than a frequency of a sub-band not in the m first sub-band sets.

14. An audio signal processing apparatus, comprising:

a memory for storing processor-executable instructions; and a processor operatively coupled to the memory, the processor being configured to execute the processor-executable instructions to facilitate the following steps:

allocate, according to a total number of bits to be allocated, a quantity of primarily allocated bits for at least a portion of sub-bands of a frame of an audio signal, wherein a quantity of the portion of sub-bands is greater than two;

perform, according to the quantity of primarily allocated bits for each of the portion of the sub-bands, a pulse quantity determination operation for each of the portion of the sub-bands respectively, so as to obtain a quantity of surplus bits of the frame, wherein the surplus bits are a part of the available bits;

select, according to a secondary bit allocation parameter, two subbands for secondary bit allocation from the portion of the sub-bands, wherein the secondary bit allocation parameter comprises: an average quantity of primary bits per unit bandwidth of each sub-band of the portion of sub-bands, and a frequency range of each sub-band of the portion of sub-bands, wherein the average quantity of primary bits per unit bandwidth of the sub-band is determined according to the quantity of primarily allocated bits of the sub-band and bandwidth of the sub-band;

allocate, according to the quantity of the surplus bits, a quantity of secondarily allocated bits for each of the two sub-bands;

determine a quantity of pulses for each of the two sub-bands respectively according to the quantity of primarily allocated bits for each of the two sub-bands and the quantity of secondarily allocated bits for each of the two sub-bands; and quantize spectral coefficients for each of the two sub-bands according to the determined quantity of pulses for each of the two subbands.

15. The apparatus according to claim 14, wherein the secondary bit allocation parameter further comprises: a quantization state of a previous-frame sub-band corresponding to each sub-band of the portion of sub-band.

16. The apparatus according to claim 14, the secondary bit allocation parameter further comprises:

a signal type of the signal of each sub-band of the portion of sub-band.

17. The apparatus according to claim 16, wherein the signal type of the signal of each sub-band of the portion of sub-band is either harmonic or non-harmonic.

18. The apparatus according to claim 14, wherein the two sub-bands selected for secondary bit allocation are successive in a frequency domain.

19. The apparatus according to claim 14, wherein the processor is further configured to execute the processor-executable instructions to facilitate the following:

determine a target sub-band set according to at least one of the quantity of surplus bits or the sub-band characteristic of the particular sub-band, wherein the two sub-bands are selected from the target sub-band set, wherein each sub-band in the target sub-band set belongs to the frame.

20. The apparatus according to claim 19, wherein the target sub-band set is determined according to a sub-band characteristic of a sub-band in m first sub-band sets one-to-one correspondingly related to m predetermined conditions, wherein m is an integer greater than or equal to 1, and each sub-band in the m first sub-band sets belongs to the frame.

21. The apparatus according to claim 20, wherein the target sub-band set corresponds to a set formed by sub-bands that belong to all the m first sub-band sets when all sub-band sets of the m first sub-band sets meet the corresponding predetermined conditions.

22. The apparatus according to claim 20, wherein the target sub-band set corresponds to a set formed by remaining sub-bands of the frame other than sub-bands that belong to all the m first sub-band sets when a sub-band set of the m first sub-band sets does not meet a corresponding predetermined condition.

23. The apparatus according to claim 20, wherein the target sub-band set corresponds to a set formed by all sub-bands in at least one sub-band set of the m first sub-band sets, each of the at least one sub-band set meeting a corresponding predetermined condition.

24. The apparatus according to claim 20, wherein the target sub-band set corresponds to a set formed by sub-bands of the frame that do not belong to any sub-band set of the m first sub-band sets when no sub-band set of the m first sub-band sets meets a corresponding predetermined condition.

25. The apparatus according to claim 20, wherein any predetermined condition of the m predetermined conditions comprises at least one of the following conditions:

that a coefficient-quantized sub-band exists in previous-frame sub-bands of a corresponding first sub-band set, that an average envelope value of sub-bands in the corresponding first sub-band set is greater than a first threshold, or that a sub-band carrying a signal of a harmonic type exists in the corresponding first sub-band set.

26. The apparatus according to claim 20, wherein a frequency of a sub-band in the m first sub-band sets is higher than a frequency of a sub-band not in the m first sub-band sets.

* * * * *